US010267045B1

(12) United States Patent
Knight, Jr. et al.

(10) Patent No.: US 10,267,045 B1
(45) **Date of Patent: *Apr. 23, 2019**

(54) METAL PANEL WALL COVER SYSTEM

(71) Applicant: McElroy Metal Mill, Inc., Bossier City, LA (US)

(72) Inventors: Stephen Finley Knight, Jr., Benton, LA (US); Tommy Lane Johnson, Bossier City, LA (US); Hunter Floyd Langdon, Shreveport, LA (US)

(73) Assignee: McElroy Metal Mill, Inc., Bossier City, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/817,067

(22) Filed: Nov. 17, 2017

Related U.S. Application Data

(63) Continuation-in-part of application No. 15/382,428, filed on Dec. 16, 2016, now Pat. No. 9,926,707.

(51) Int. Cl.

| | |
|---|---|
| ***E04F 13/08*** | (2006.01) |
| ***E04F 13/26*** | (2006.01) |
| ***E04F 13/12*** | (2006.01) |
| ***E04F 13/24*** | (2006.01) |

(52) U.S. Cl.
CPC ..... *E04F 13/26* (2013.01); *E04F 13/12* (2013.01); *E04F 13/24* (2013.01)

(58) Field of Classification Search
CPC ..... E04F 13/12; E04F 13/36; E04F 13/24
See application file for complete search history.

(56) References Cited

U.S. PATENT DOCUMENTS

| | | | | |
|---|---|---|---|---|
| 3,321,883 | A * | 5/1967 | Pascucci | E04F 13/0803 52/391 |
| 4,288,958 | A * | 9/1981 | Chalmers | E04F 13/0864 52/478 |
| 5,394,666 | A | 3/1995 | Zahner, III | |
| 6,098,363 | A * | 8/2000 | Yaguchi | E04F 13/0801 52/385 |
| 6,883,290 | B2 | 4/2005 | Dinwoodie | |
| 8,713,864 | B1 | 5/2014 | Smith, Jr. | |
| 8,887,464 | B1 | 11/2014 | Smith, Jr. | |
| 8,938,927 | B1 | 1/2015 | Bragg | |

(Continued)

OTHER PUBLICATIONS

ASC Profiles LLC, *Flex Series—AEP Span* (Jul. 2016).

(Continued)

*Primary Examiner* — Beth A Stephan
(74) *Attorney, Agent, or Firm* — Keith B. Willhelm

(57) ABSTRACT

Metal panel sidings have panel clips and a cover. The panel clips are mounted in linear arrays to a wall. The cover has a plurality of elongated metal panels having lateral side laps and a show side. The side laps extend inward from the show side. The panel clips have a first catch engaging a side lap of a first panel and a second catch engaging a side lap of a second, adjacent panel. The side laps provide vertical seams between adjacent panels. The first catch of the clips is mounted to the wall. The second catch is coupled to the first catch for movement from an unset position to a set position. The second catch does not engage the side lap of the second panel in its unset position, and engages the side lap of the second panel in its set position. Straps preferably are installed on the panels.

19 Claims, 24 Drawing Sheets

(56) References Cited

U.S. PATENT DOCUMENTS

| | | | | |
|---|---|---|---|---|
| 9,016,008 | B2 | 4/2015 | Knighton | |
| 9,074,372 | B2 | 7/2015 | Laurin et al. | |
| 9,181,692 | B1 | 11/2015 | Callaway et al. | |
| 9,206,606 | B2 | 12/2015 | Jaks | |
| 9,453,339 | B2 | 9/2016 | Baxter et al. | |
| 2005/0055903 | A1 | 3/2005 | Greenberg | |
| 2006/0026921 | A1* | 2/2006 | Krause | E04F 13/0832 52/550 |
| 2013/0183088 | A1* | 7/2013 | Wilkinson, Jr. | F16B 3/00 403/354 |
| 2014/0202094 | A1* | 7/2014 | Bilge | E04F 13/0805 52/235 |

OTHER PUBLICATIONS

Centria, *Ceniria Product Catalog—Reimagine Metal* (Copyright 20151.

Imetco,*PermWall* (Copyright 2010).

McElroy Metal, Inc., *Wave Panel—Product Data* (Rev. Date Sep. 24, 2015).

Metal Construction Assn., *Oil Canning in Metal Roof and Metal Wall Systems* (Copyright 2013).

Peterson Aluminum Corporation, *Flush/Reveal Wall Panels* (Copyright 2015-2016).

McElroy Metal, *Marquee—Lok and Marquee-II Architectural Wall, Fascia and Soffit Panels* (Rev. 11/13).

* cited by examiner

METAL PANEL WALL COVER SYSTEM

FIELD OF THE INVENTION

The present invention relates to metal panel sidings and methods and tools for installing metal panel sidings.

BACKGROUND OF THE INVENTION

A variety of metal sidings are used in the construction industry to provide the outermost barrier to wind and water on a building's exterior walls. Metal sidings can provide excellent weather resistance and durability and may have a service life of up to 40 years. One common type of metal siding utilizes rather elongated metal panels fabricated from sheet metal, so-called single skin panels. Each panel is typically about a foot to three feet in width. Though they may be cut to any length, they commonly are 30 to 40 feet long and may run as long as 200 feet. The lateral edges of the panels are bent into various lateral patterns to provide side laps. The laps of adjacent panels are overlapped, abutted, interlocked, or in some other fashion connected or "seamed" to form a cover.

Metal panel sidings will incorporate various flashings, trim pieces, sealants, and other components where the field of a wall terminates, such as at the top and bottom of a wall, interior and exterior corners, and around doors and windows. Even where a building has many intersecting walls, doors, windows, and the like, however, the basic assembly of metal panel sidings over the major expanse of walls is fairly uniform. The panels will be mounted on the wall by various clips and fasteners and their laps will be seamed. They perhaps are most commonly installed vertically, that is with the length of the panel running vertically across the wall. The panels, however, may be installed horizontally, that is, with the length of the panel running horizontally across the wall.

Siding systems incorporating single skin panels are commonly classified according to the manner in which they are installed on a wall. In an "exposed fastener" system, panels are configured so that the laps of adjacent panels will overlap. Fasteners, such as gasketed screws, are driven through the overlap and elsewhere on the panels to mount them to the wall. As their name implies, the fasteners are visible to the eye and exposed to the elements. Penetration of water around the fasteners can be a problem, particularly as the siding ages.

"Concealed fastener" systems may incorporate panels which have various prominent rib profiles. That is, the panel is bent along various lateral lines to create ribs running along the length of the panel. The ribs create space underneath the panels which provides clearance for a fastener driven through the overlap between adjacent panels. The panels will overlie the fasteners when the cover is complete, and thus water penetration around the fasteners is less likely.

Other panels are designed to be installed with concealed clips. In a typical concealed clip system, relatively small panel clips are installed on the wall in linear arrays. The arrays may run horizontally across the face of the wall or vertically, but in either event, they define what will become the seam line between adjacent panels. Panels then are installed and seamed on the clips. There are no penetrations through the panels when clips are used. Thus, concealed clip system may be less susceptible to water penetration.

One common type of concealed clip panel is provided with a "hook and cleat" interlock, such as the Wave Panel siding system manufactured by McElroy Metal Mill, Inc. In the Wave Panel system, the lap on one side of a panel is bent over laterally to form a hook running along the length of the panel. The other lap is closely doubled over to form a relatively narrow channel also running the length of the panel. The clips have a similar closely doubled over portion which may be mated with the channel on the panels. An array of clips is engaged with a first panel along its lap channel and mounted to the wall with fasteners. The clips and channel lap on the first panel, thus secured, provide a "cleat" into which the "hook" on the lap of a second panel may be inserted.

It will be appreciated that metal panels are exposed to a range of temperatures, particularly in certain geographic areas. Surface temperature of the panels may be 100° F. higher than ambient air temperature. A steel panel, for example, may expand and contract over a range of 1" per 100 linear feet. An aluminum panel may expand and contract even more, perhaps over a range of 2" per 100 linear feet. Panel temperatures will cycle daily and yearly, and over the life of the siding the panels may go through tens of thousands of cycles.

Neither exposed nor concealed fasteners, however, may adequately allow for thermal expansion of the panels. The panels cannot shift relative to the fasteners so changes in temperature can create uneven stress through the panels. Given the extremely high ratio of their length and width to their thickness, differential stress arising from other factors almost always is present in metal panels. Thermal expansion and contraction, however, can exacerbate such stresses and increase waviness and wrinkling of the panels. Such effects are commonly referred to as "oil canning" and reduce, in the eyes of many, the aesthetic appeal of a siding.

Oil canning may be made less conspicuous, and to a certain degree minimized by the design and finish of the panel. Panel ribs not only allow for more even, controlled distribution of stress, but they also break up the surface of the siding, making canning less obvious. Canning also is most apparent when viewed through reflected light. Thus, canning will be less visible when panels are made in lighter colors, or when panels have lower gloss or textured surfaces. Many exposed and concealed fasteners systems rely on such strategies to minimize noticeable canning.

On the other hand, canning is much more apparent in flat, unprofiled panels, or in panels where there are relatively few, more widely spaced ribs. Perhaps because highly profiled panels are so ubiquitous, there is an aesthetic appeal to cleaner, more flush siding finishes. Flatter, less profiled panels also may allow insulation to be installed under the panel without appreciably increasing the overall thickness of the siding. They also may provide an essentially continuous drain plane behind the panel.

Concealed clip fasteners typically will allow for thermal expansion and thereby reduce canning. Hook and cleat style laps and clips, however, cannot be used to provide sidings with a flush finish, that is, a siding where panels are arranged side to side with snug, even seams and "show" sides. Accordingly, manufacturers have developed concealed clip systems where a vertical seam is provided between flush, flat panels. The seams are referred to as "vertical" seams because they extend away from the wall. It will be noted too that "vertical" seams may run horizontally or vertically across the wall depending on the orientation of the panels.

The PermWall system manufactured by Imetco is an example of a "snap-in" system which joins flat panels at vertical seams. One lap of the panel, together with the clip, serves as a "socket." The other lap serves as a "post" which may be snapped into the socket. Viewing the panel as oriented for installation, the socket lap of the panels is bent inward and then doubled over. It forms a relatively wide channel extending perpendicularly inward from the panel show side. The post lap extends perpendicularly inward as well, but it is bent into an outwardly facing barb. The clip is essentially a hook on a right-angle bracket. That is, the clip has a flat base with a perpendicular outward extension. The end of the outward extension is provided with an inward facing hook.

A seam may be formed between adjacent panels by first hooking an array of clips over the upper portion of the channel on the socket lap of a first panel. The clip hook extends only partially into the channel. The clips then are mounted to the wall by driving fasteners through their base. The post lap of a second panel then may be snapped into the socket lap of the first panel. That is, the post lap will flex allowing it pass over and beyond the clip hook. Once the second panel is snapped into place, interference between the outward barb on the post lap and the inward facing hook on the clips prevents the seam from disassembling. The panels, however, can "float" on the clips as they expand and contract.

Such panels, like the typical concealed fastener panels, are asymmetrical. That is, the panels do not have a lateral axis of symmetry. More to the point, the laps on asymmetrical panels are different, and typically may be thought of as mating male-female connections. Each panel has a male connection formed in one lap and a female connection formed in its other lap. Thus, installation must proceed in a certain direction across the wall, and removal for repair must proceed in the opposite direction. A damaged interior panel may only be accessed by removing the last panel installed and all other panels "down installation" from the damaged panel. More importantly, the process of removing the down installation panels is highly likely to damage the panels to the extent that they are not suitable for reinstallation.

Moreover, the process of forming asymmetrical panels may increase the susceptibility of the panel to canning. That it, their sides being different, each lap is bent in different ways and to different extents than the lap on the other side of the panel. The stress produced by such forming, like the panels themselves, is asymmetrical. It is not symmetrically distributed through the panel. As the panel attempts to relieve that differential stress, it is more likely to bend and twist.

The PermWall system also cannot easily accommodate panels of differing heights. That is, many architects and property owners may want to create a siding which in large part is flush and smooth. At the same time, by varying the extent to which the show side of panels extend from a wall, i.e., the height of the panels, patterns may be created to accent or enhance architectural features of the structure.

The statements in this section are intended to provide background information related to the invention disclosed and claimed herein. Such information may or may not constitute prior art. It will be appreciated from the foregoing, however, that there remains a need for new and improved systems, apparatus and methods for installing metal panel sidings. Such disadvantages and others inherent in the prior art are addressed by various aspects and embodiments of the subject invention.

SUMMARY OF THE INVENTION

The subject invention, in its various aspects and embodiments, is directed generally to metal panel siding systems. As will be appreciated from the full disclosure, various embodiments provide features which provide resistance to thermally induced oil canning. Other embodiments provide features which allow sidings to be more easily and economically repaired or which allow disengagement of panels without damage. Yet other embodiments provide tools which may be used to install novel sidings.

One broad embodiment of the subject invention provides for a metal panel siding system installed on a structure such as a building. The siding system comprises a plurality of panel clips and cover attached to the panel clips. The panel clips are mounted in linear arrays to a wall of the structure. The cover comprises a plurality of elongated metal panels having lateral side laps and a show side extending between the side laps. The side laps extend inward from the show side. The panel clips comprise a first catch engaging one of the side laps of a first one of the panels and a second catch engaging one of the side laps of a second, adjacent one of the panels. Thus, the side laps provide vertical seams between the adjacent panels.

The first catch of the panel clips is mounted to the wall. The second catch is coupled to the first catch for movement relative to the first catch. The second catch also is moveable during installation of the panels from an unset position to a set position. The second catch does not engage the side lap of the second panel in its unset position. The second catch engages the side lap of the second panel in its set position.

Various other aspects and embodiments provide such systems having reveal panels. The panel clips mentioned above may be referred to as standard panel clips and are used with a reveal panel clip. A plurality of reveal panel clips is mounted in linear arrays to a wall of the structure. The metal panels mentioned above may be referred to as standard or flush panels and together with the reveal panels, they provide a cover. The reveal panels have lateral side laps and a show side extending between the side laps. The side laps extend inward from the show side and support the show side of the reveal panel away from the wall at an elevation different from an elevation of the flush panels. The reveal panel is joined along its side laps to one of the side laps of a first one of the flush panels and to one of the side laps of a second one of the flush panels. Thus, first and second vertical seams join the reveal panel and the first and second flush panels.

The reveal panel clips have a catch. They are arrayed along the first seam such that the catch of the reveal panel clips engages the side lap of the first flush panel. The standard panel clips are arrayed along the second seam such that the second catch of the standard panel clips engages the side lap of the second flush panel.

Additional embodiments provide such siding systems where the side laps of the flush panels comprise a leg portion extending inward from the show side of the panels and a foot portion extending from the leg under the show side. The side laps of the reveal panels comprise a leg portion extending inward from the show side of the panels and a foot portion extending from the leg away from the show side. The foot on the side laps of the flush panels is a fold, and the foot on the side laps of the reveal panel is inserted into the fold.

Other aspects provide such siding systems where the first catch and the second catch are adapted to engage the panel side laps such that the clips do not restrict movement of the panels along the linear clip arrays.

Another aspect provides such siding systems where the second catch is coupled to the first catch for movement between the unset position and the set position.

Especially preferred embodiments include siding systems where the first catch has guides adapted to receive the second catch such that the second catch can slide from the unset position to the set position.

Yet another aspect provides siding systems where the second catch may be releasably locked in the unset position or the set position. Other aspects provide systems where the first catch and the second catch are provided with mating nubs adapted for releasable engagement to releasably lock the second catch in the unset or the set position.

Still other aspects provide siding systems wherein the standard panel clips comprise a vertical fence restricting lateral movement of the side laps of the panels and, especially on the second catch.

Additional embodiments provide siding systems where the standard clip comprises a stop limiting movement of the second catch past the set position, such as a tab on the second catch which is adapted to engage a track on the first catch.

Various aspects will provide systems where the panel clips are arranged in linear arrays running horizontally or vertically across the wall or where the panel clips are mounted to framing members of the wall or to other portions of the wall.

Other aspects provide siding systems where the side laps of the flush panels comprise a leg portion extending inward from the show side of the panel and a foot portion extending from the leg generally parallel to and under the show side. Another aspect provides siding system where the panels are symmetrical.

Yet other embodiments provide such siding systems which comprise a plurality of straps. The straps engage the side laps of one of the panels and extend therebetween to provide lateral flex in the panel. In other aspects, the system comprises a plurality of straps which have a hook at each end of the strap. The hooks are adapted to engage foot portions of the side laps of one of the panels and extend therebetween to provide lateral flex in the panel.

Still other broad embodiments provide methods of installing a wall cover for a structure such as a building. The method comprises installing a plurality of panel clips on a wall of the structure. The panel clips being installed in linear arrays running across the wall and have a mountable catch and a settable catch. The settable catch is moveable relative to the mountable catch. Metal panels are attached to the panel clips to form at least a portion of the wall cover. The panels having an inwardly extending side lap. The panel clips are installed, and the panels are attached to the panel clips by engaging one of the side laps of a first one of the panels with the mountable catches of one or more of the panel clips. The mountable catches are installed on the wall. One of the side laps of a second one of the panels is placed adjacent the side lap of the first panel. The settable catch of the panel clip then is moved into engagement with the side lap of the second panel. Other embodiments of the method comprise installing straps on the side laps of panels to provide lateral flex in the panels.

Various other broad aspects of the invention provide metal panel siding systems installed on a structure. The siding system comprise a plurality of elongated panel clips mounted to a wall of the structure. A cover is attached to the panel clips. The cover comprises a plurality of elongated metal panels having lateral side laps and a show side extending between the side laps. The side laps of the panels comprise a leg portion extending inward from the show side of the panel and a foot portion extending from the leg under the show side. The panels are joined along their side laps to provide vertical seams. The panel clips comprise a pair of deflectable catches. The catches are deflectable to accommodate the insertion of the feet on abutting legs of adjacent the panels into the deflectable catches and thereafter to engage the feet.

Other embodiments provide such siding systems where the deflectable catches comprise a riser extending upward from a base and a face extending downward and inward from the riser or where the clips extend continuously and are mounted across at least two frame members extending generally perpendicularly to the continuous clips.

Still other embodiments provide such siding systems which comprise a plurality of straps. The straps engage the side laps of one of the panels and extend therebetween to provide lateral flex in the panel.

Various other aspects and embodiments provide such systems having reveal panels. The panel clips mentioned above may be referred to as standard panel clips and used with a reveal panel clip. A plurality of reveal panel clips is mounted in linear arrays to a wall of the structure. The metal panels mentioned above may be referred to as standard or flush panels and together with the reveal panels, they provide a cover. The reveal panels have lateral side laps and a show side extending between the side laps. The side laps extend inward from the show side and support the show side of the reveal panel away from the wall at an elevation different from an elevation of the flush panels. The reveal panel is joined along its side laps to one of the side laps of a first one of the flush panels and to one of the side laps of a second one of the flush panels. Thus, first and second vertical seams join the reveal panel and the first and second flush panels.

The reveal panel clips comprise a pair of deflectable catches. The catches of the first panel clips are deflectable so as to accommodate the insertion of one of the side laps of the reveal panel and one of the side laps of a first one of the flush panels as well as the other side lap of the reveal panel and one of the side laps of a second one of the flush panels. Once inserted therein, the reveal panel catches engage the flush panel side laps and reveal panel side laps.

Other embodiments provide such systems where the side laps of the reveal panel comprise a leg portion extending inward from the show side of the panel and a foot portion extending from the leg away from the show side. The foot on the side laps of the flush panels is a fold and the foot on the side laps of the reveal panel is inserted into the fold.

Yet other aspects provide such systems where the deflectable catches of the reveal panel clips have a riser extending upward from a base and a face extending downward and inward from the riser. Additional embodiments provide such systems where the clips extend continuously and are mounted across at least two frame members extending generally perpendicularly to the continuous clips.

Various aspects will provide systems where the panel clips are arranged in linear arrays running horizontally or vertically across the wall or where the panel clips are mounted to framing members of the wall or to other portions of the wall.

Other aspects provide siding systems where the side laps of the flush panels comprise a leg portion extending inward from the show side of the panel and a foot portion extending from the leg generally parallel to and under the show side. Another aspect provides siding system where the panels are symmetrical.

Additional aspects are directed to methods of installing such siding systems.

Yet other broad embodiments provide metal panel siding systems installed on a structure. The siding systems comprise a plurality of panel clips mounted in linear arrays to a wall of the structure. A cover is attached to the panel clips. The cover comprises a plurality of elongated metal panels having lateral side laps and a show side extending between the side laps. The side laps extend inward from the show side. The panel clips comprise first and second catches. The first catch of a first panel clip engages a first side lap of a first panel and the second catch of the first panel clip engages a second side lap of the first panel. The first catch of a second panel clip engages a first side lap of a second panel and the second catch of the second panel clip engages a second side lap of the second panel. The second panel clip is mounted relative to the first panel clip such that the first side lap of the second panel abuts the second side lap of the first panel to provide a vertical seam between the first and second panels.

Other embodiments provide such siding systems where the panel clips comprise a fence. The fence has a first portion restricting lateral movement of the side laps of the panels and a second portion restricting vertical movement of a second panel clip engaging the panel clip.

Various aspects will provide systems where the panel clips are arranged in linear arrays running horizontally or vertically across the wall or where the panel clips are mounted to framing members of the wall or to other portions of the wall.

Other aspects provide siding systems where the side laps of the flush panels comprise a leg portion extending inward from the show side of the panel and a foot portion extending from the leg generally parallel to and under the show side. Another aspect provides siding system where the panels are symmetrical.

Yet other embodiments provide such siding systems which comprise a plurality of straps. The straps engage the side laps of one of the panels and extend therebetween to provide lateral flex in the panel. In other aspects, the system comprises a plurality of straps which have a hook at each end of the strap. The hooks are adapted to engage foot portions of the side laps of one of the panels and extend therebetween to provide lateral flex in the panel.

Other related broad embodiments provide methods of installing a wall cover for a structure. The method comprises installing a plurality of panel clips on a wall of the structure. The panel clips are installed in linear arrays running across the wall and have first and second catches. Elongated panels are attached to the panel clips to form at least a portion of the wall cover. The panels have an inwardly extending side lap. The panel clips are installed, and the panels are attached to the panel clips by engaging a first side lap of a first panel with the first catch of a first panel clip. The first panel clips are installed on the wall. The second catch of the first panel clip is engaged with a second side lap of the first panel. A second panel then is positioned such that a first side lap of the second panel abuts the second side lap of the first panel. The first lap of the second panel then is engaged by a first catch of a second panel clip. The second panel clip then is installed on the wall.

Other broad embodiments provide such methods where a plurality of straps is installed on the side laps of the panels. The straps provide lateral flex in the panels. Yet other embodiments provide such methods where straps have a hook at each end of the strap. The straps are installed by engaging the hooks with foot portions of the side laps on one of the panels. They extend across the side laps and provide lateral flex in the panels.

Various other broad embodiments provide metal panel siding systems which incorporate flush and reveal metal panels. The siding system also includes a plurality of elongated panel clips mounted to a wall of the structure. A cover is attached to the panel clips. The comprises elongated metal flush panels and at least one elongated metal reveal panel. The flush and reveal panels have lateral side laps and a show side extending between the side laps. The side laps of the flush panels comprise a leg portion extending inward from the show side of the panel and a foot portion extending from the leg under the show side. The side laps of the reveal panel comprise a leg portion extending inward from the show side of the panel and a foot portion extending from the leg away from the show side. The side laps support the show sides of the flush and reveal panels at different elevations away from the wall. The reveal panels are joined along their side laps to one of the side laps of a first one of the flush panels and to one of the side laps of a second one of the flush panels. Thus, first and second vertical seams are formed and join the reveal panel and the first and second flush panels. The panel clips comprise a pair of deflectable catches. The catches are deflectable so as to accommodate the insertion of a foot on one of the side laps of the reveal panel and a foot of one of the side laps of an adjacent flush panel into the deflectable catches and thereafter to engage the reveal panel and flush panel feet.

Other embodiments provide such siding systems which comprise a plurality of straps. The straps engage the side laps of one of the panels and extend therebetween to provide lateral flex in the panel. In other aspects, the system comprises a plurality of straps which have a hook at each end of the strap. The hooks are adapted to engage foot portions of the side laps of one of the panels and extend therebetween to provide lateral flex in the panel.

Preferred aspects of such systems include systems where the on the side laps of the flush panels is a fold and the foot on the side laps of the reveal panel may be inserted into the fold for insertion of the feet into the deflectable catches or where the deflectable catches comprise a riser extending upward from a base and a face extending downward and inward from the riser.

Other aspects of the invention include methods for installing such siding systems.

Various other broad aspects and embodiments include siding systems having a a cover comprising a plurality of elongated metal flush panels and at least one elongated metal reveal panel. The reveal panel is mounted to a wall of the structure. The flush and reveal panels have lateral side laps and a show side extending between the side laps. The side laps of the flush panels comprise a leg portion extending inward from the show side of the panel and a foot portion extending from the leg under the show side. The side laps of the reveal panel comprise a leg portion extending inward from the show side of the panel, a foot portion extending from the leg away from the show side, and a deflectable catch extending from the foot. The side laps support the show sides of the flush and reveal panels away from the wall at different elevations. The reveal panel is joined along its side laps to a side lap of a first flush panel and to a side lap of a second flush panel, thereby providing first and second vertical seams joining the reveal panel and the first and second flush panels. The catches are deflectable so as to accommodate the insertion of a foot on a side lap of an adjacent flush panel into the deflectable catches and thereafter to engage the reveal panel foot.

Other aspects of the invention include methods for installing such siding systems.

In other broad aspects and embodiments, the invention provides panel clips. The panel clips comprise a first catch engaging a side lap of a first panel and a second catch engaging a side lap of a second, adjacent panel. Thus, the panel clips facilitate joining of the side laps to provide vertical seams between the adjacent panels.

The first catch of the panel clips is mounted to the wall. The second catch is coupled to the first catch for movement relative to the first catch. The second catch also is moveable during installation of the panels from an unset position to a set position. The second catch does not engage the side lap of the second panel in its unset position, and engages the side lap of the second panel in its set position.

Another aspect provides such panel clips where the second catch is coupled to the first catch for movement between the unset position and the set position.

Especially preferred embodiments include such panel clips where the first catch has guides adapted to receive the second catch such that the second catch can slide from the unset position to the set position.

Yet another aspect provides such panel clips where the second catch may be releasably locked in the unset position or the set position. Other aspects provide panel clips where the first catch and the second catch are provided with mating nubs adapted for releasable engagement to releasably lock the second catch in the unset or the set position.

Still other aspects provide such panel clips wherein the standard panel clips comprise a vertical fence restricting lateral movement of the side laps of the panels and, especially on the second catch.

Additional embodiments provide such panel clips where the clip comprises a stop limiting movement of the second catch past the set position, such as a tab on the second catch adapted to engage a track on the first catch.

Still other broad embodiments provide tools for manipulating panel clips used in metal panel siding systems. The tool comprises a handle adapted for grasping and manipulation of the tool. A head is mounted at one end of the handle. The tool head adapted to engage a panel clip having a first component adapted for mounting to the structure and a second component carried on the first clip component for sliding movement relative to the first clip component. The tool head has a bearing surface adapted to bear on the second clip component and, thereby, to transmit force applied through the tool handle to the second clip component to push the second clip component in a first direction. The tool head also has a grabber adapted to engage the second clip component and, thereby, to transmit force applied through the tool handle to the second to pull the second clip component in a second, opposite direction. Preferred embodiments have a flat bearing surface.

The invention, in still other broad embodiments, also provides for metal panel siding systems installed on a structure such as a building. The systems comprise a cover installed on a wall of the structure and a plurality of straps. The cover comprises a plurality of elongated metal panels having lateral side laps and a show side extending between the side laps. The straps engage the side laps of the panels. They extend between the side laps to provide lateral flex in the panels.

Other such embodiments provide systems where the side laps of adjacent panels are engaged to provide vertical seams between the adjacent panels. Still other such embodiments provide systems where the panels are asymmetrical panels and the straps engage a side lap of a first panel and a side lap of a second panel. Yet other such embodiments provide systems where the panels are symmetrical panels and the straps engage the side laps of the same panel.

Finally, still other aspect and embodiments of the invention will have various combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

BRIEF DESCRIPTION OF THE DRAWINGS

FIG. 2 shows novel siding 10 after a first panel 20 has been installed and a second panel 20 is being installed, an enlarged portion thereof being shown in FIG. 2A.

FIG. 3 shows novel siding 10 after the second panel 20 has been installed and a third panel 20 is being installed, an enlarged portion thereof being shown in FIG. 3A.

FIG. 15 shows novel siding 210 after a first panel 20 has been installed and a second panel 20 is being installed, an enlarge portion thereof being shown in FIG. 15A.

FIG. 16 shows novel siding 210 after the second panel 20 has been installed and a third panel 20 is being installed, an enlarged portion thereof being shown in FIG. 16A.

FIG. 20 shows novel siding 310 after a first panel 20 has been installed, reveal panel 340 has been partially installed, and a second panel 20 is being installed.

FIG. 21 shows novel siding 310 after reveal panel 350 and second panel 20 have been installed.

Figure 1:
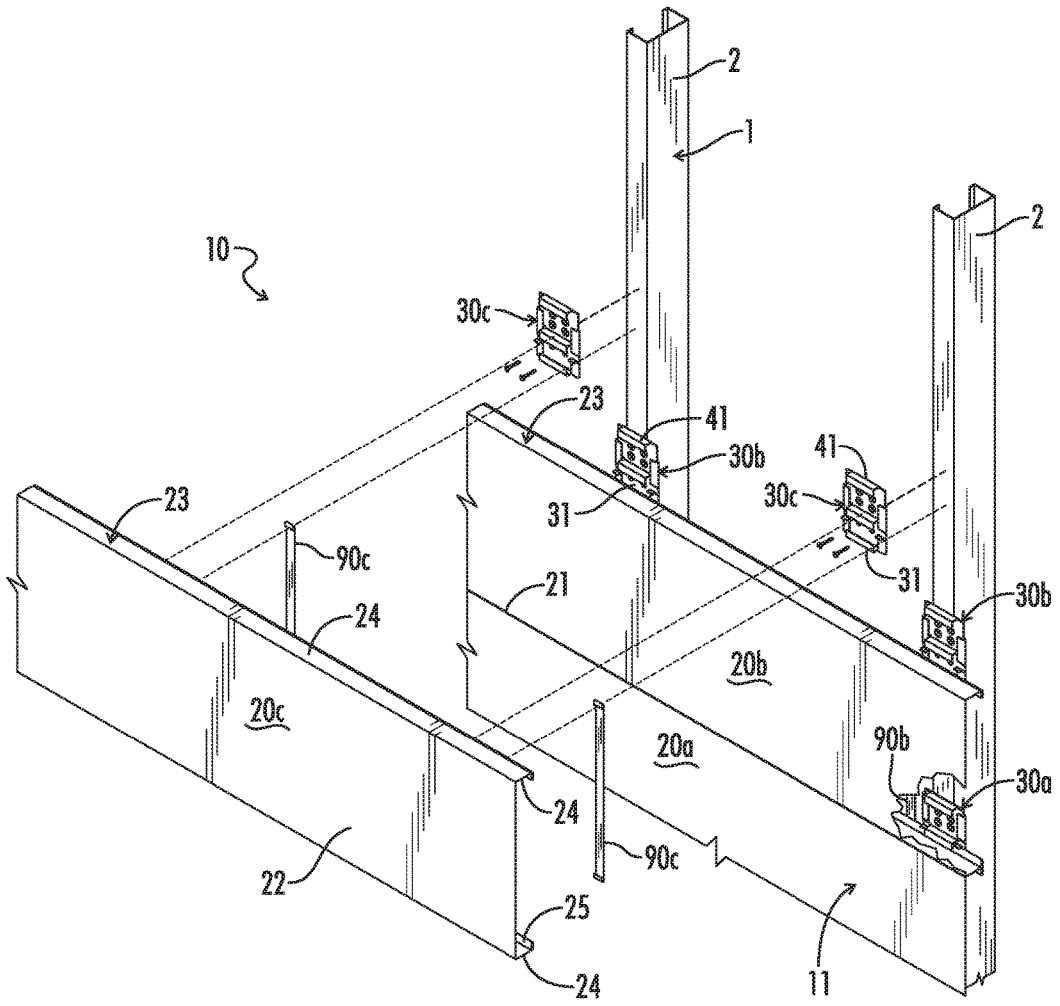
FIG. 1 is an isometric, partially exploded view of a field portion of a first preferred embodiment 10 of the metal panel sidings of the subject invention.

In the drawings and description that follows, like parts are identified by the same reference numerals. It also will be apparent from the discussion that follows that certain conventions have been adopted to facilitate the description of the novel systems which typically include large numbers of identical components. For example, as discussed below, various embodiments include a plurality of panels 20. Specific individual panels 20 may be identified in the drawings, or referenced in the discussion as 20*a*, 20*b*, 20*c*, etc. to distinguish a particular panel 20 from another panel 20. The drawing figures are not necessarily to scale. Certain features of the embodiments may be shown exaggerated in scale or in somewhat schematic form and some details of conventional design and construction may not be shown in the interest of clarity and conciseness.

DESCRIPTION OF ILLUSTRATIVE EMBODIMENTS

The present invention generally relates to metal panel sidings for the walls of buildings and other structures. Specific embodiments will be described below. For the sake of conciseness, however, all features of an actual implementation may not be described or illustrated. In developing any actual implementation, as in any engineering or design project, numerous implementation-specific decisions must be made to achieve a developer's specific goals. Decisions usually will be made consistent within system-related and business-related constraints. Specific goals may vary from one implementation to another. Development efforts might be complex and time consuming and may involve many aspects of design, fabrication, and manufacture. Nevertheless, it should be appreciated that such development projects would be routine effort for those of ordinary skill having the benefit of this disclosure.

Walls may have many different designs, but one common design incorporates a structural frame. The frame will incorporate vertical support members, such as columns and studs, and horizontal support members, such as girts. Barrier films and insulating panels may be installed on the frame. Similarly, the wall may incorporate sheathing, such as plywood or oriented strand board (OSB) sheets, or spaced boards ("nailers"). The sheathing provides additional structural support for the wall. A cover then is installed to provide the outermost barrier to wind, water, and the other elements.

The novel sidings provide wall covers which may be installed on many different walls in many different ways. The cover may be installed directly on framing or installed over sheathing. It may be anchored to frame members or to sheathing. The novel sidings may be used in new construction, and they may be installed over many types of existing wall covers. Moreover, the novel sidings may be installed on other types of walls, such as masonry walls.

Broader embodiments of the novel siding systems utilize panel clips where the clips are mounted in linear arrays along a wall. A plurality of metal panels is attached to the clips to form a cover. The panels have lateral side laps with a show side extending between the side laps. The side laps extend inward from the show side such that the side laps, once the panels are installed, provide vertical seams between the panels. The panel clips have a first catch and a second catch. The first catch is mounted to the wall and engages the side lap of a panel. The second catch is movably coupled to the second catch. During installation, it can move from an open or unset position to a closed or set position in which it engages the side lap of a second panel. Preferably, straps are installed to assist in minimizing oil canning through the panels.

Figure 2:
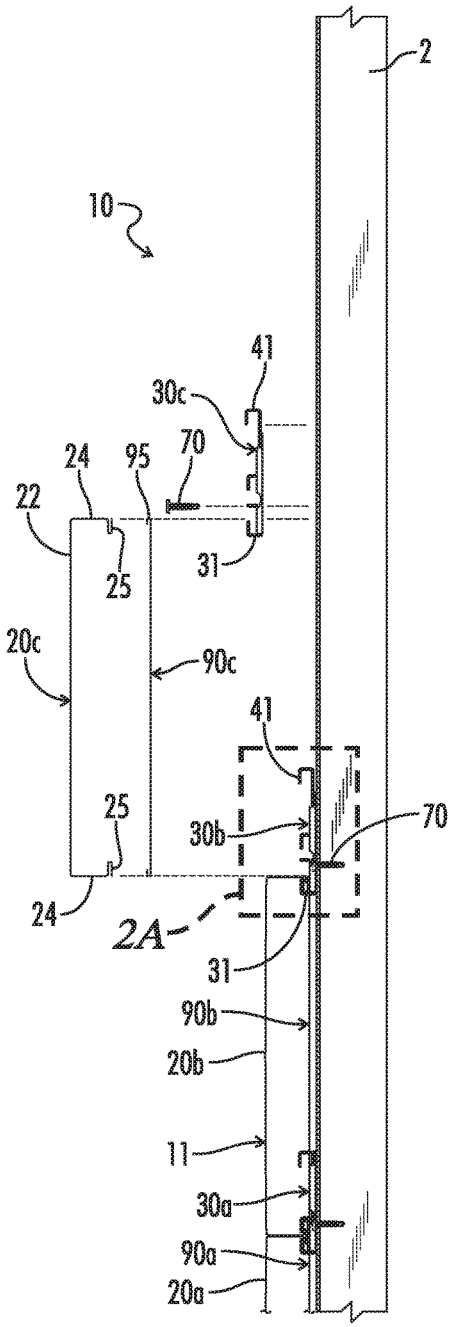
FIGS. 2-3 are sequential, horizontal cross-sectional, partially exploded views illustrating the installation of novel siding 10 on purlins 2 of a wall frame 1.
Figure 3:
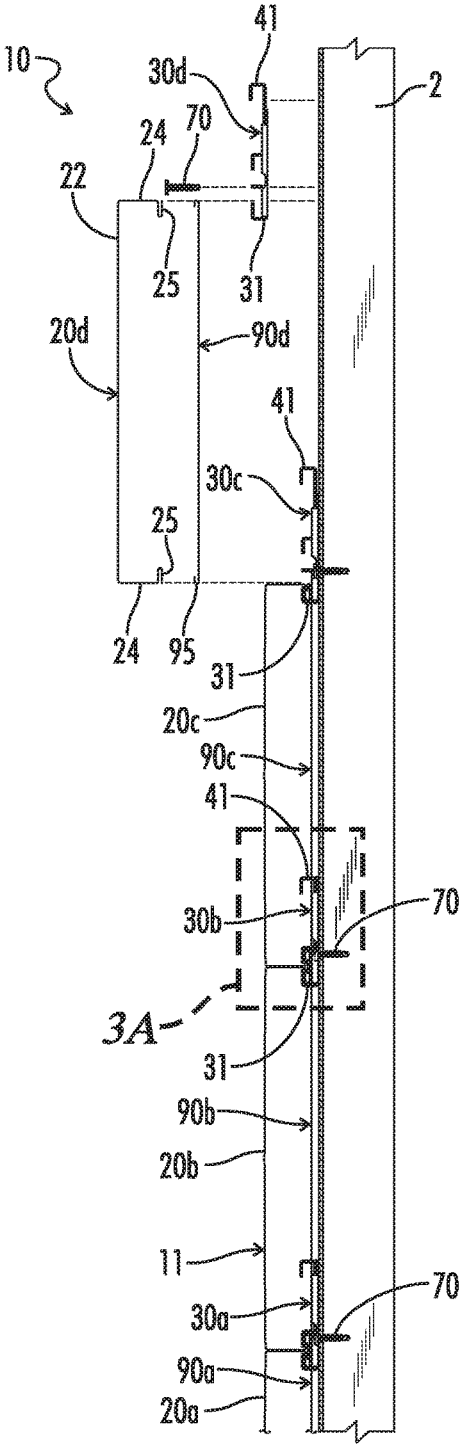

For example, as shown in FIGS. 1-3, a first preferred embodiment 10 of the novel siding systems may be installed on conventional metal wall framing 1. Frame 1 includes an array of vertically extending support members, such as metal studs 2. Horizontal support members, such as girts, also may be incorporated into frame 1. Studs 2 and, if present, girts typically will be fabricated from formed sheet metal. As shown, studs 2 are C-shaped, but other stud configurations may be suitable, such as Z-shaped studs. Likewise, "hat channel" girts may be used, or they may have other configurations. It also will be appreciated that suitable framing may be made of wood, such as dimensional lumber, and other conventional building materials and components.

Novel siding 10 generally comprises a plurality of metal wall panels 20, a plurality of panel clips 30, and preferably a plurality of panel straps 90. As best appreciated from FIG. 1, siding 10 is a "horizontal" installation. That is, metal panels 20 run horizontally and are interconnected at horizontally extending seams 21. The portion of panels 20 which extends between seams 21 provides an external face or "show" side 22. It will be understood that a run of panels 20 may extend for substantial lengths, and eventually terminate at a corner, door, window or another feature of the wall. A single panel 20 may extend for the length of that run, or the run may be completed by overlapping two or more shorter panels 20.

It also will be appreciated that panels 20 will be installed across frame 1 in a prescribed order. For example, as illustrated in FIGS. 1-3, panels 20 will be installed bottom-up. A first panel 20*a*, or a run of panels 20*a*, will be installed proximate the lower extent or base of frame 1, typically with a flashing (not shown). A second panel 20*b* or run of panels 20*b* will be installed above first panel 20*a*, and so on until the upper extent or cap of frame 1 is reached and frame 1 is completely covered.

Figure 2A:
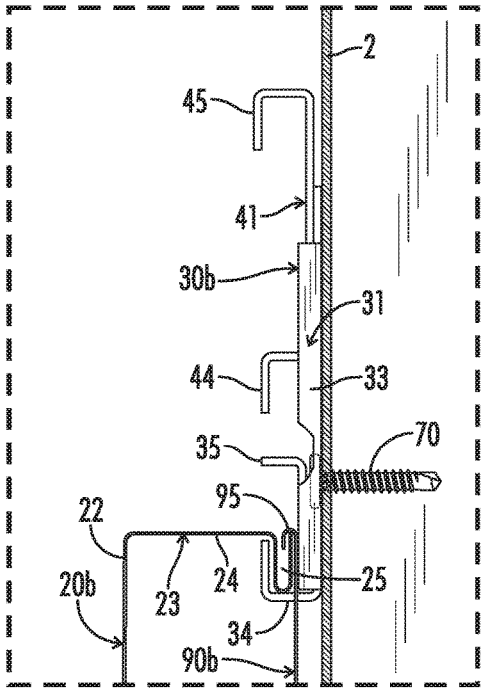
Figure 3A:
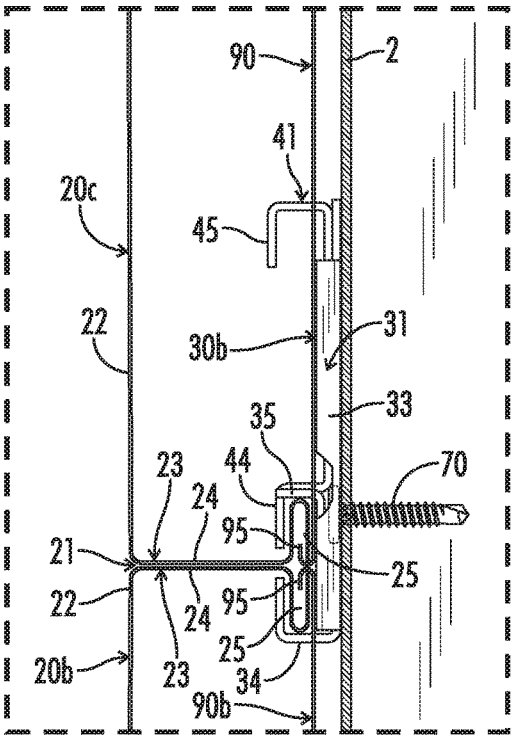
Figure 4:
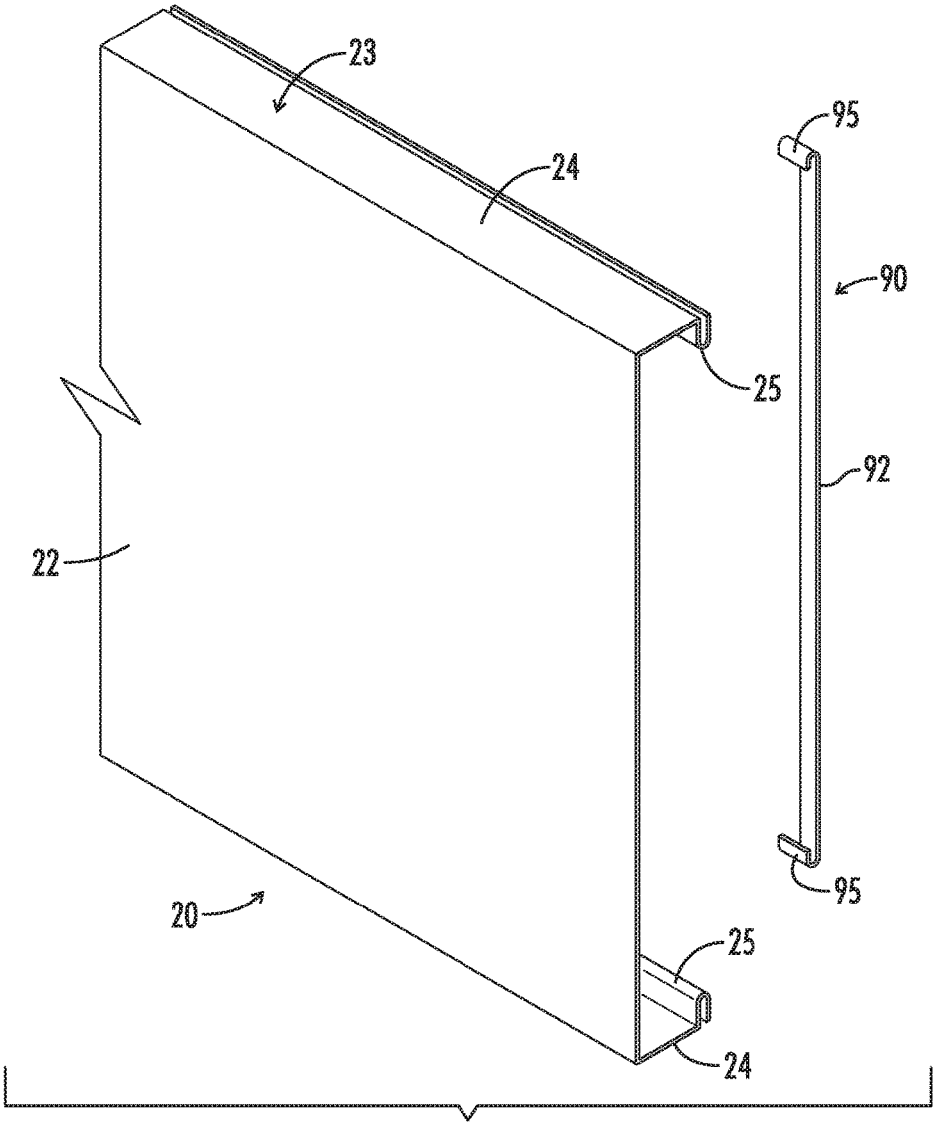
FIG. 4 is an isometric view, taken generally from the front, of panel 20 used in siding 10 and an isometric view of a first preferred embodiment 90 of the novel panel straps used in siding 10.

Panels 20 have side laps 23 which may be joined to form vertical seams 21. Side laps 23 are formed by bending the lateral edges of panels 20 into a desired configuration. For example, as best appreciated from FIGS. 2A, 3A, and 4 side laps 23 of panels 20 include an inwardly extending leg 24 and a foot 25. Foot 25 may be a simple extension or, as shown, a folded portion. Preferably, as shown, leg 25 extends approximately perpendicular to show side 22, and foot 25 extends approximately perpendicular from leg 24 and under show side 22 of panel 20. It will be noted that metal panels 20 are symmetrical, that is, their side laps 23 are mirror images.

Figure 5:
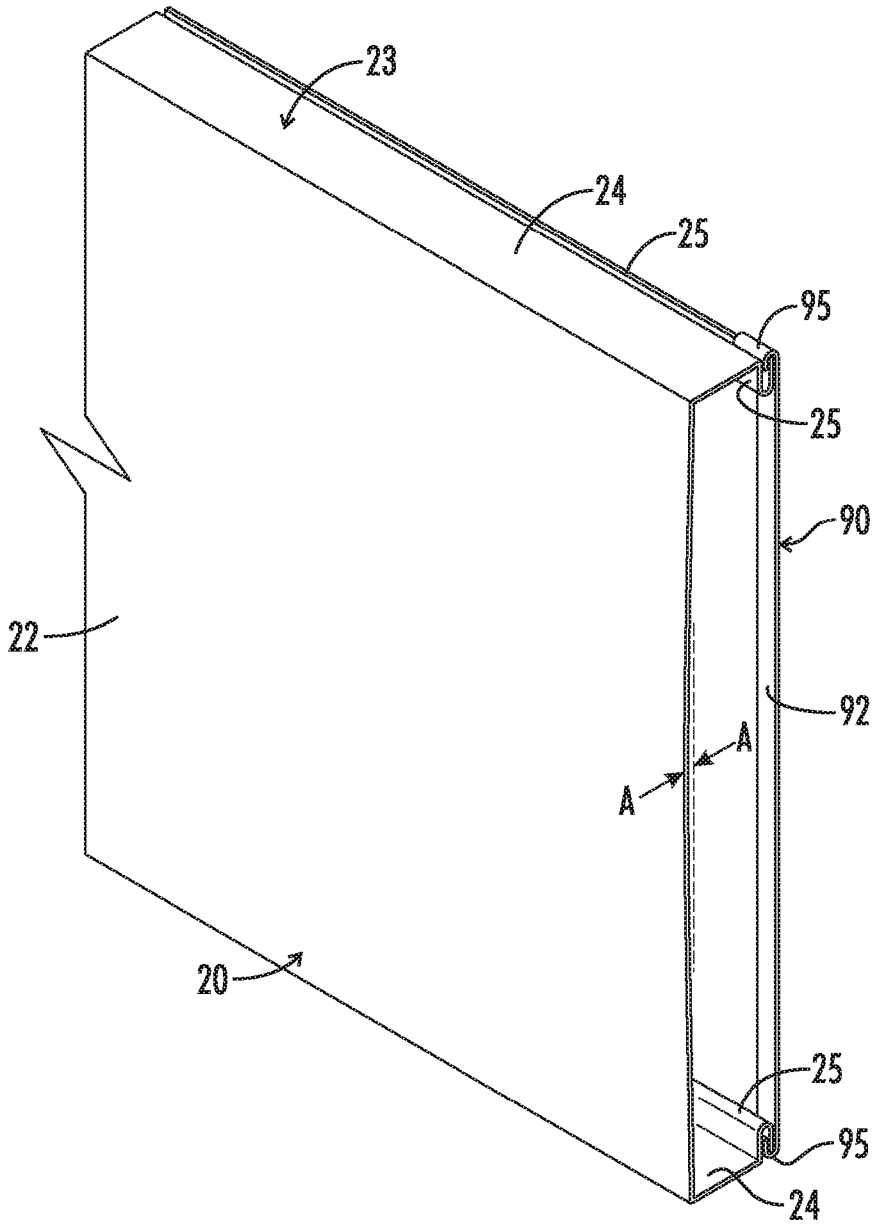
FIG. 5 is an isometric view, taken generally from the back of panel 20, showing strap 90 assembled to panel 20.

Transverse straps preferably are used in the novel siding systems to help further minimize oil canning or at least the visual perception of canning. For example, as shown in FIGS. 1-3, straps 90 are incorporated into siding 10. Straps 90 have a relatively thin, narrow body 92 having a transverse hook 95 at each end as seen best in FIGS. 4-5. Straps 90 are installed transversely across the back or inside of panels 20 by engaging strap hooks 95 with feet 25 on opposing side laps 23 of panels 20. The length of straps 90 will be coordinated such that they are slightly shorter than the spacing between feet 25. Thus, when straps 90 are installed on panels 20, they will cause legs 24 to bend inward toward each other, which in turn will induce a slight, outward bow running transversely along the length of panels 20. That slight bow is indicated by arrows A-A in FIG. 5.

The precise number and spacing of straps 90 required for a particular installation will vary. A typical installation may include straps 90 at spacings of approximately 5 feet. Greater or fewer straps 90, however, may be used. The spacing of straps may depend, for example, on the stiffness of panels 20, the degree of flex imparted by each strap 90, and the environmental conditions in which siding 10 is installed. It also will be appreciated that straps 90 may have various configurations which will allow them to be used with other types of panels. Likewise, while preferably incorporated therein, the novel siding systems do not necessarily require straps.

Panel clips are used to secure metal wall panels to a wall and to facilitate the formation of seams between the metal panels. Panel clips 30, for example, are used to secure metal panels 20 to studs 2 of frame 1 and to facilitate the formation of seams 21 between laterally adjacent panels 20 as seen best in FIGS. 1-3. As described in further detail below, panel clips 30 are installed in linear arrays. The arrays of panel clips 30 run horizontally from stud 2 to stud 2 of frame 1 along what will become seam lines for metal panels 20. Thus, the linear arrays of clips 30 are spaced vertically by a distance substantially equal to the width of metal panels 20.

Greater or fewer clips 30 may be used in the arrays depending upon the conditions to which siding 1 will be exposed. Where wind uplift is of minimal concern, fewer clips 30 may be necessary. Clips 30 might be required, for example, only every other or every third stud 2. Thus, when studs 2 are relatively closely spaced, frame 1 may not necessarily incorporate girts 3. If studs 2 are widely spaced, or more clips 30 are otherwise required between studs 2, girts or other horizontal frame members may be incorporated into frame 1. Girts also will be necessary for most vertical installations as most studs or other vertical frame members might not be spaced the width of the panels.

Figure 6:
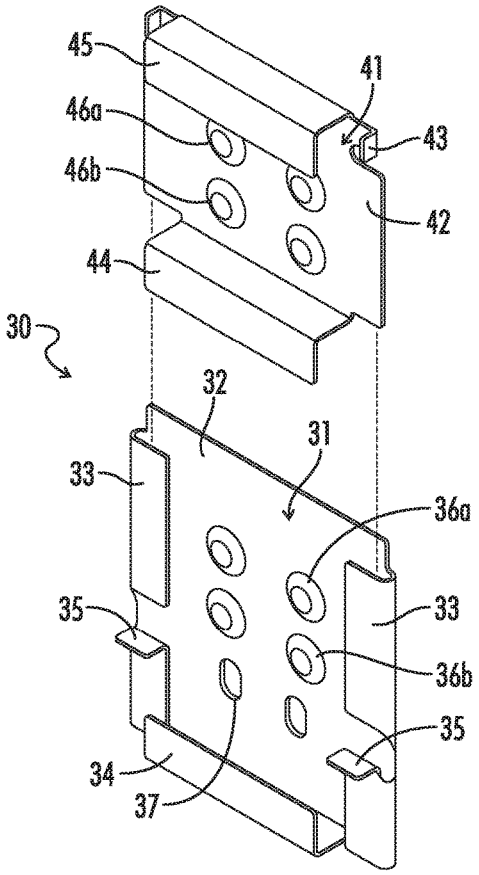
FIG. 6 is an isometric, exploded view of a first preferred embodiment 30 of clips used in novel siding 10.
Figure 7:
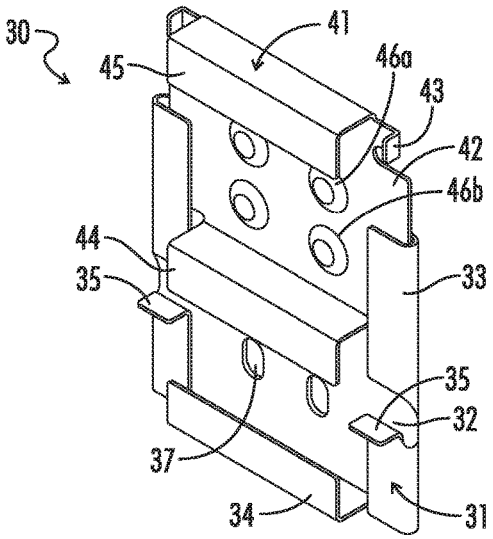
FIG. 7 is an isometric view of clip 30 in its unset position.
Figure 8:
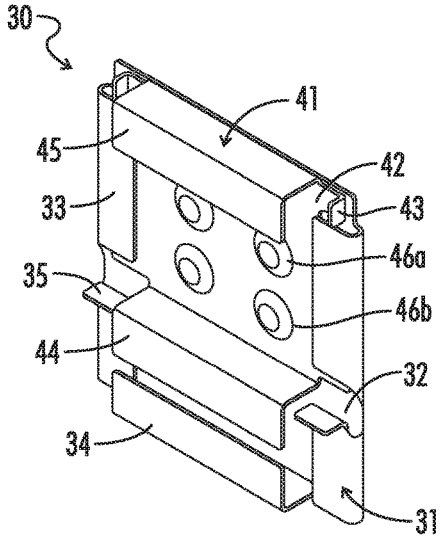
FIG. 8 is an isometric view of clip 30 in its set position.

In accordance with broad aspects of the invention, the clips have a first catch which is mounted to a wall and a second catch which is moveable from an unset position to a set position. Preferably, the second catch is moveable between its unset and set positions, i.e., back and forth. For example, as seen best in FIGS. 6-8, panel clips 30 include a track 31 and a sled 41. As described in detail below, clip track 31 is mounted to a stud 2 and clip sled 41 is able to slide back and forth between an unset position and a set position.

Track 31 generally comprises a bottom plate or base 32 which has been shaped to provide a pair of guides 33 along its sides and a catch 34 at its forward end. Guides 33 may be provided, for example, by folded portions extending from base 32 which form a pair of relatively wide, relatively low clearance channels. Guides 33 extend along the substantial length of track 31. Catch 34 may be provided, for example, by an upward extension from base 32 which is doubled back to form a rearward-facing hook. Catch 34 extends across the substantial portion of the forward end of track 31. Preferably, as shown, track 31 also comprises a fence 35. Fence 35 may be provided, for example, by cutting out small portions of guides 33 and bending them upward to provide a pair of upstanding tabs.

Sled 41 generally comprises a bottom plate or base 42 which has been shaped to provide a catch 44 at its forward end and a grab 45 at its rearward end. Catch 44 is provided by an upward extension from base 42 which in turn is provided with a forward extension. Upward and forward extensions form a forward-extending, elevated tab. Grab 45 is provided by an upward extension which is doubled back to form a forward-facing hook.

Sled 41 is slidably carried on track 31. Lateral edges of sled 41 are inserted into guides 33 of track 31 such that sled 41 is carried therein and may slide between, i.e., back and forth between a rearward, open, unset position and a forward, closed, set position. As discussed in detail below, slidable sled 41 will allow a panel 20 to be engaged by and disengaged from clip 30.

One or more embossments, such as nubs 36, preferably are provided on base 32 of track 31. Nubs 36 provide a convex projection on the top surface of track base 32. Base 42 of sled 42 preferably is provided with two sets of embossments, such as nubs 46*a* and 46*b*. Nubs 46 provide concave recesses in the bottom surface of sled base 42. Nubs 36 and 46 are sized and configured such that they may be shifted into and out of mating engagement. Nubs 46*a* and 46*b* also are spaced from each other such that sled 41 may be selectively and releasably locked in its unset and set positions. That is, sled 41 may be releasably locked in its unset position by engaging nubs 46*a* on sled 41 with nubs 36 on track 31. Sled 41 may be releasably locked in its set position by engaging nubs 46*b* on sled 41 with nubs 36 on track 31.

It will be appreciated, however, that oversetting of clips 30 can induce stress in panels 20 and contribute to undesirable oil canning. Thus, clips 30 also preferably include a stop limiting the movement of sled 41 along track 31 beyond its set position. Sled 41, for example, comprises a stop 43. Stop 43 is provided by cutting out a small portion of sled base 42 and bending it upward to provide an upstanding tab. Stop 43 is adapted to engage one of guides 33 on track 31 to limit travel of sled 41 along track 31. More specifically, stop 43 will limit movement of catch 44 on sled 41 towards catch 34 on track 31, preventing catches 44 and 34 from creating excessive stress on panels 20. Other configurations, of course, may be used to provide interference between sled 41 and track 31 and minimize clip-induced canning.

Panel clips 30 are attached to studs 2 of frame 1 by fasteners, such as a pair of screws 70, extending through base 32 of track 31. A greater or lesser number of screws 70 or other fasteners may be used to mount panel clips 30 to studs 2. Typically, at least two fasteners will be used to resist torque about the connections and to provide greater stability for clips 30. Where wind uplift is of minimal concern, however, it may be possible to mount panel clips 30 with a single fastener. Conversely, additional screws 70 or other fasteners may be installed through track base 32 when more stability and strength is required in the connection between panel clips 30 and frame 1.

Preformed slotted apertures 37 preferably are provided in base 32 of track 31 to accommodate screws or other fasteners and to provide some flexibility in locating track 31. If desired, however, round fastener holes may be provided, or screws may be driven through base 32. The exact length of track 31 and base 32 thereof, as well as the placement, configuration, and number of apertures 37, preferably are coordinated to allow for some imprecision in placement of clips 30 during installation.

Siding 10 may be installed by installing a first panel 20*a* along the base of frame 1 as best appreciated from FIGS. 1-3. The lower side lap 23 (not shown) of base panel 20*a* is secured at the bottom of frame 1. Lower side lap 23 of base panel 20*a* may be secured by a conventional hook-style clip and flashing installed along the base of frame 1. Such components, and other conventional components that may be used in the base area of frame 1 have been omitted from the drawings for the sake of clarity.

Panel clips 30 will be used to attach, and facilitate and secure the formation of vertical seams 21 between base panel 20*a* and the rest of panels 20 installed. For example, and as shown in FIGS. 1-3, seams 21 may be formed between a second panel 20*b* and a third panel 20*c*. An array of panel clips 30*b* is installed on studs 2 by driving fasteners 70 through their tracks 31 as described above. When track 31 is mounted to girt 3, sled 42 will be releasably locked in its unset position. In its unset position, sled 41 provides sufficient clearance to allow second panel 20*b* to be secured to clip 30*b*. For example, the top side lap 23 of base panel 20*b* will be laid across guides 33 of track 31. Foot 25 of side lap 23 then may be slid into and under catch 34 of track 31 as shown in FIG. 2. Straps 90*b* typically will have been installed on panel 20*b* before it is set in clips 30*b*, but in some installations, it may be easier to install straps 90*b* after setting panel 20*b*.

Third, higher panel 20*c* then may be installed. Typically, straps 90*c* will be attached to panel 20*c*. The bottom side lap 23 of panel 20*c* then will be placed on guides 33 of track 31 between side lap 23 of second panel 20*b* and fence 35. Once panel 20*c* is thus positioned, sled 42 may be slid forward and releasably locked into its forward, closed, set position as shown in FIG. 3. When sled 42 is in its set position, catch 44 extends over foot 25 on side lap 23 of panel 20*c*. Preferably, a sealant, such as a bead of silicone caulk or elastomeric tape, is provided between side laps 23 of panels 20 to enhance the weather tightness of seams 21. In any event, when clips 30 are set panels 20*b* and 20*c* will be securely engaged and held adjacent to each other to provide vertical seams 21.

Once third panel 20*c* has been installed on clips 30, its other side lap 23 will be installed on another array of clips 30*c* in the same manner as was side lap 23. Additional panels 20 then may be installed, continuing upward from panel 20*c* until frame 1 has been completely covered.

It will be appreciated that siding 10 has been exemplified in the context of a field portion of a wall. The field of a cover typically will constitute the clear majority of a siding installation and a major component of its cost. Walls, however, may incorporate many different architectural features and may have many different or intersecting fields. The novel siding systems may be adapted accordingly and will incorporate various components to complete certain portions of an installation either for functional purposes, such as weather sealing, or for aesthetic purposes.

For example, the walls of buildings almost always incorporate windows and often have doors or other openings. They may have bay windows or other projections as well. Special components may be required to install around openings or projections. The walls usually terminate at a base, a soffit, or an inside or outside corner. Special components also may be required for such features. Similarly, flashing, sealants, and finish components may be installed in around many wall features. A wide variety of such components and installation methods are known in the art and may be used in the novel siding systems. Many embodiments of the novel siding systems also may incorporate insulation, such as fiberglass bats or foam boards, without appreciably increasing the overall thickness of the siding. The panels in many installations are elevated well away from the wall surface or framing and provide adequate space for insulation.

The panels used in the novel recover metal roofs are the same type of single skin metal panels as are conventionally used in metal panel sidings and roofs. Thus, they may be fabricated from materials and by methods as are commonly employed in the art. Typically, such panels are fabricated from roll stock of painted or unpainted coated steel, such as Galvalume™ steel, zinc, copper, or aluminum. The roll stock is fed into a roll former which shapes the metal sheet into the desired configuration and cuts it to a desired length. Preformed panels may be used for a particular installation and cut as necessary, or a former may be mounted on a trailer or truck so that panels may be fabricated on a job site. It will be appreciated, however, that the panels may be made of other materials, such as rigid, moldable or extrudable plastic. The straps typically will be fabricated from the same materials and by the same methods as the panels.

It also will be appreciated that the novel metal panel sidings are exemplified as using symmetrical metal panels of a particular configuration. Other types of symmetrical panels may be used, however, as may be asymmetrical metal panels. A variety of conventional symmetrical and asymmetrical panels which form vertical seams are known and may be adapted for use in the subject invention. For example, 138T and 238T symmetrical metal panels sold by McElroy Metal may be used.

The clips used in the novel metal panel roof recovers preferably are made from steel, such as 16 to 24-gauge galvanized steel sheets that may be easily formed and bent and cut into a desired configuration by conventional metal forming equipment. Such materials provide a rugged, weather resistant clip that may be manufactured easily and economically. Other metals, such as extruded aluminum, may be used to fabricate the panel clips, however, as well as rigid, moldable or extrudable plastics.

The exact dimensions of novel panel clips and their various features are not especially critical and may be varied to provide as much or as little engagement with the panels as may be desired or necessary for a particular installation. The novel clips also may have various configurations including, but not limited to the specific preferred embodiments discussed herein. The size and configuration of the panel clips also will be coordinated with the choice of panels used in the novel siding systems.

Thus, it will be appreciated that the novel siding systems offer important advantages and benefits. Siding 1, for example, is resistant to thermally induced canning. That is, as appreciated from FIG. 3A, when clips 30 are set, side lap 23 of panel 20*c* will be prevented from shifting away from side lap 23 of panel 20*b* by fence 34. Panel 20*c* may be pulled and tugged as its other side lap 23 is attached to the next array of clips 30. Fence 30 will prevent panel 20*c* from separating away from panel 20*b* and shifting sled 41 back into its unset position. Side lap 23 of panel 20*c* will be prevented from pulling away from track 31 by catch 44 on sled 41, and side lap 23 of panel 20*b* will be prevented from separating away from side lap 23 of panel 20*c* and from pulling away from track 31 by catch 34 on track 31.

At the same time, however, neither catch 34 on track 31 nor catch 44 on sled 41 restrict movement of panels 20 along the linear array of clips 30 to which they are engaged. Panels 20 are free to slide horizontally within and across clips 30 as they expand and contract due to changes in temperature. Panels 20 will remain securely engaged with clips 30, yet differential stress and canning that otherwise would arise if panels 20 were restricted from moving by clips 30 will be avoided.

As noted, straps 90 also help in reducing oil canning. By inducing uniform stress in panels 20, that is, a transverse bowing in panels 20, the tendency of the panel to warp irregularly is diminished. There will be tendency to relieve that stress created by straps 90 as panels 20 are subjected to thermal expansion and contraction.

It also will be appreciated that siding 10 may easily and economically repaired, especially as compared to conventional concealed fastener siding systems having a vertical seam between the panels. That is, panels 20 may be disengaged from clips 30 without damaging the panel. For example, installed upper panel 20*c* seen in FIG. 3 may be disengaged from clip 30 simply by sliding sled 41 back to its unset position. No longer restricted by catch 44 on sled 41, panel 20*c* may be pulled off and away from clip 30 which in turn allows lower panel 20*b* to be disengaged from catch 34 on track 31. If a panel such as panel 20*b* is damaged and must be replaced, therefore, panel 20*c* and the panels 20 above it, i.e., the "down installation" panels 20 may be removed—without damage—and then later reinstalled. Though not readily appreciated from FIGS. 1-3, there may be many panel runs along a wall, dozens or more. The ability to reinstall panels which have been removed to accommodate repairs can add up to substantial cost savings.

Figure 9:
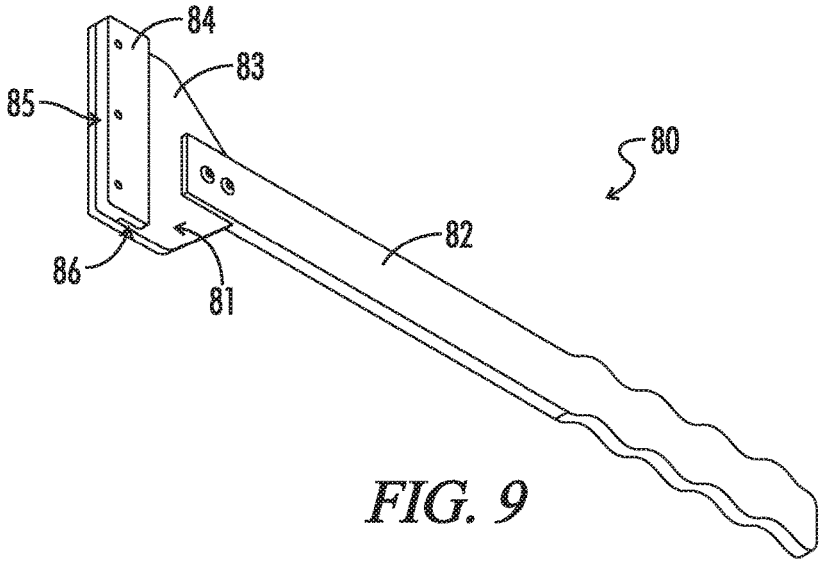
FIG. 9 is an isometric view of a preferred embodiment 80 of the novel tools of the subject invention, tool 80 being bottom-up.
Figure 10:
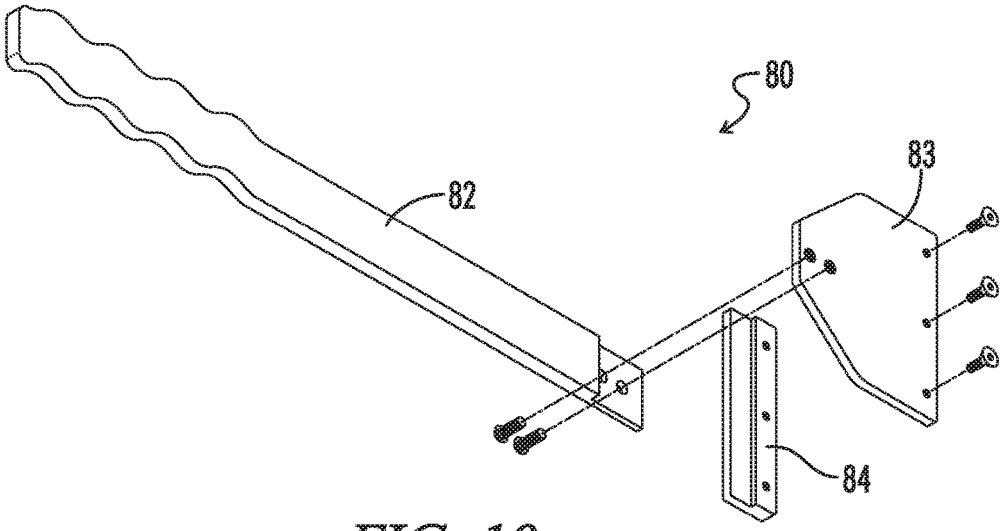
FIG. 10 is an exploded, isometric view of tool 80.
Figure 11:
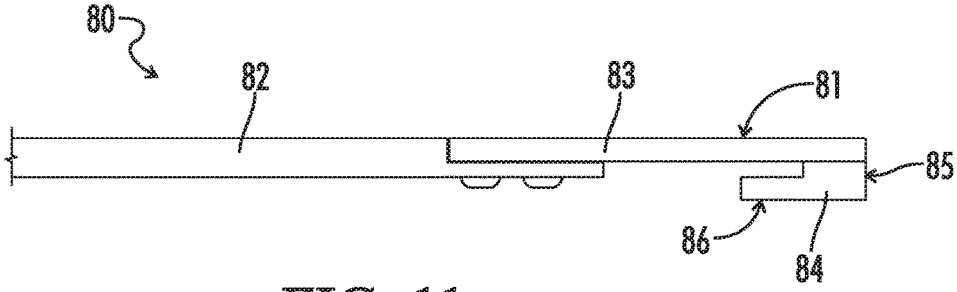
FIG. 11 is an enlarged, side elevational view of the head 81 of novel tool 80.

Other aspects of the subject invention provide tools which may be used to install the novel sidings. The novel tools provide a bearing surface by which moveable clip components may be pushed and a grabber by which they may be pulled. For example, tool 80, which is shown in FIGS. 9-11, may be used to push and pull on sled 41 of clips 30 as may be required to install or uninstall siding 10. As may be seen therein, installation tool 80 generally comprises a head 81 from which extends a handle 82. Handle 82 may be provided with conventional ergonomic features, such as contours and gripping features, either as integral components or separate components. Preferably, handle 82 is sufficiently long to allow an installer to easily convey head 81 under a panel 20 and into engagement with clips 30.

Head 81, as best seen in the exploded view of FIG. 10, has a two-piece design comprising a base 83 and a lip 84. Base 83 of head 81 has an overall prismatic shape which may be visualized an a relatively short, "house-shaped" right pentagonal prism. The rear end of head base 83 and the forward end of handle 82 are provided with mating geometries and are securely fastened together, for example, by several set screws.

Lip 84 is securely fastened to the end of base 83 with, for example, several set screws, thus providing head 81 with a bearing surface 85 and a grabber 86. That is, the front surface of head 81 is substantially flat and provides a bearing surface 85. By comparing, for example, FIG. 7 with FIGS. 9-11, it will be appreciated that bearing surface 85 of head 81 may be brought to bear on the upward extension of grab 45 on sled 41 to push sled 41 from its unset position to its set position.

Lip 84 extends across and over the forward portion of body 83. As seen best in the cross-sectional view of FIG. 11, lip 84 and the forward end of base 83 form a relatively narrow, elongated hook-shaped grabber 86. Grabber 86 may be engaged with grab 45 on sled 41 to pull sled 41 from its set position to its unset position.

The head of the novel tools may be sized and configured in various ways consistent with its use in pushing and pulling sled 41. For example, grabber 86 of tool 80 may be rim or other simple downward extension from bearing surface 83. A rim or other forward extension may be provided on bearing surface 83 to help ensure that head 81 properly seats on grab 45 as tool 80 is used to push sled 41. Grab 45 and sled 41 in clips 30 also may be configured in various ways, and head 81 of tool 80 modified accordingly.

Likewise, the novel tools may be fabricated and assembled in various ways. The three-piece design of tool 80 allows it to be easily manufactured and assembled from durable materials such as steel. Head 81 or the entire tool 80, however, may be formed integrally. For example, tool 80 may be formed from molded rubber with or without a reinforcing core. Suitable cores may be fabricated from, e.g., metal or fiberglass, and may be simple rods or may have a shape generally conforming to the shape of the tool head and handle.

Figure 12:
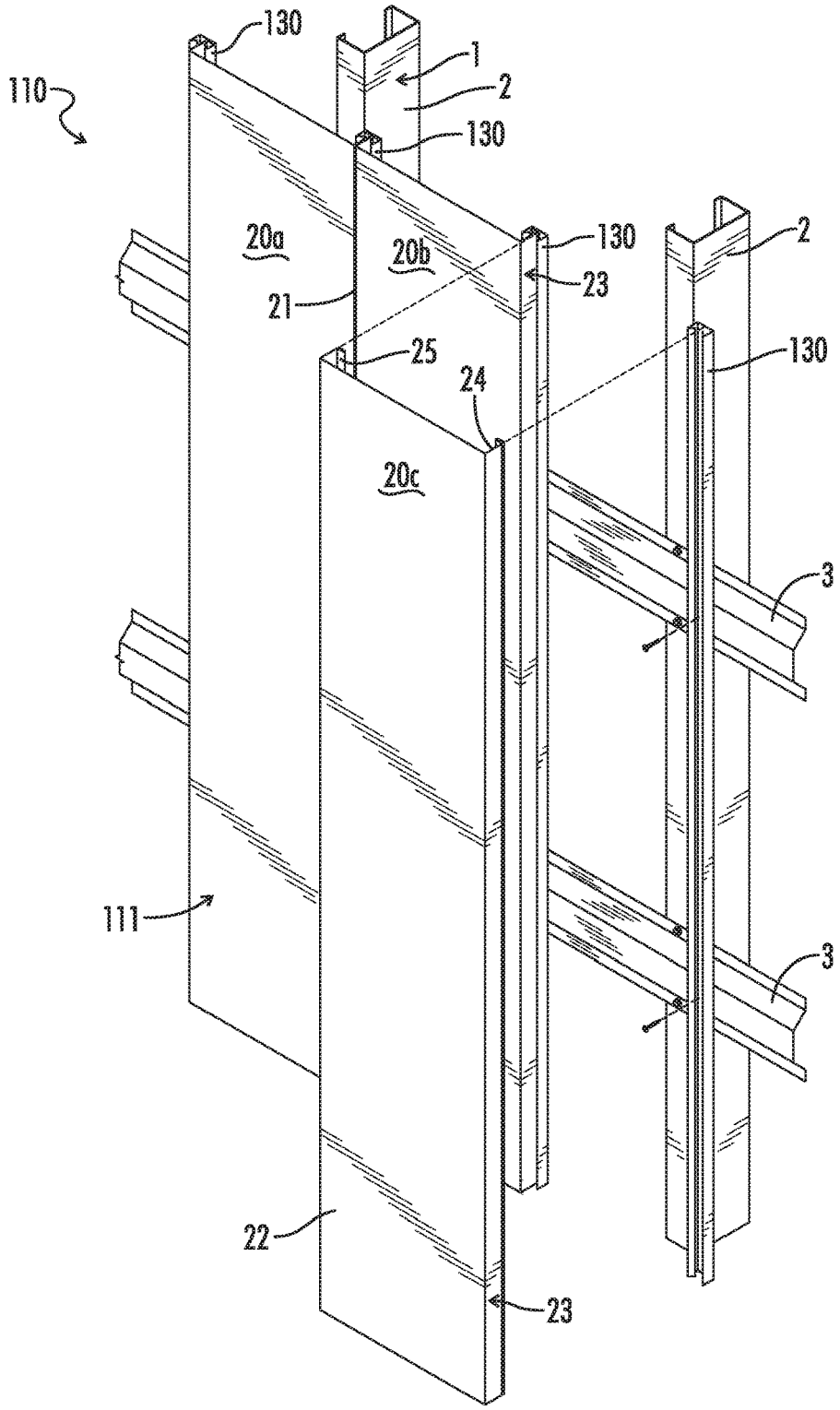
FIG. 12 is an isometric, partially exploded view of a field portion of a second preferred embodiment 110 of the novel metal panel sidings.
Figure 13:
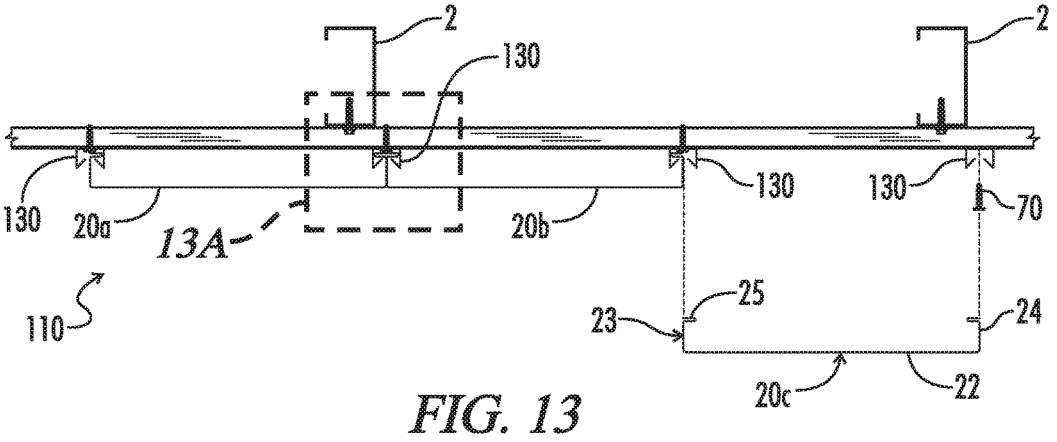
FIG. 13 is a cross-sectional view of a field portion of novel siding 110, an enlarged portion thereof being shown in FIG. 13A.

A second preferred embodiment 110 of the novel siding systems is shown in FIGS. 12-13. As may be seen therein, siding 110 is similar in certain respects to siding 10. Siding 110 generally comprises a plurality of panels 20 installed on clips, but instead of linear arrays of clips 30, siding 110 uses elongated clips 130. Clips 130 provide a snap-in connection between side laps 23 of panels 20. Siding 110 also is installed vertically, i.e., it is installed such that panels 20 extend vertically across the face of the wall. As is typical of vertical installations, frame 1 also incorporates an array of horizontally extending support members, such as metal "hat channel" girts 3, which are secured to vertical studs 2.

Figure 13A:
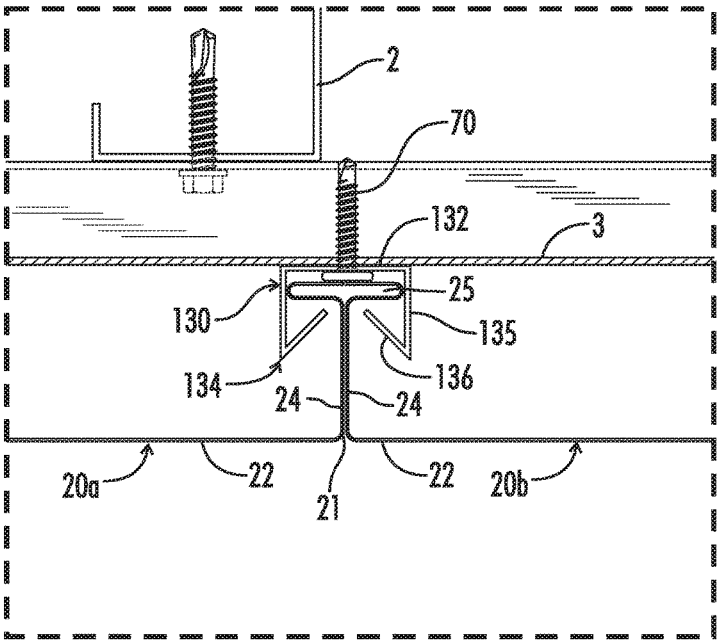
Figure 14:
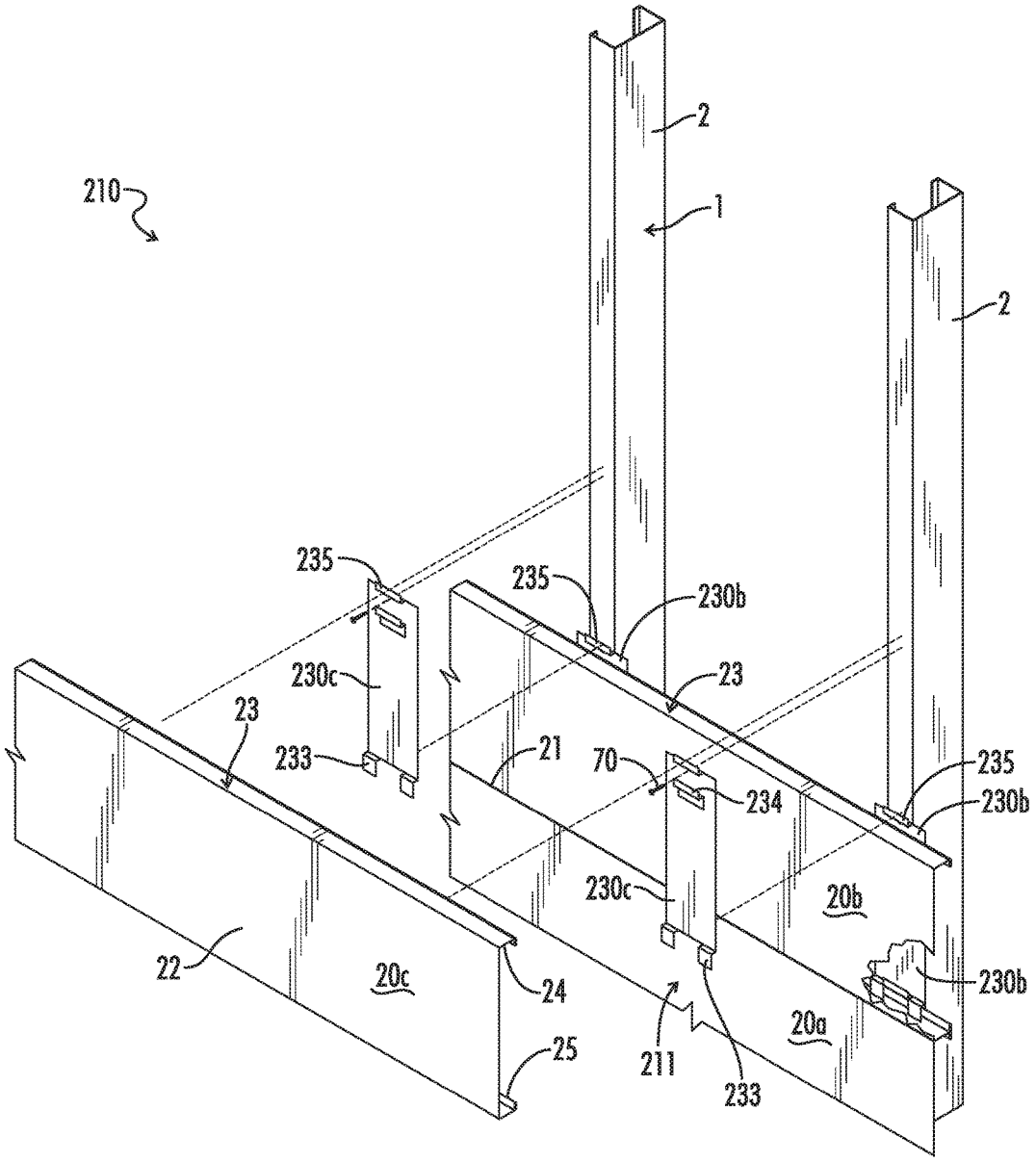
FIG. 14 is an isometric, partially exploded view of a field portion of a third preferred embodiment 210 of the novel metal panel sidings.
Figure 15:
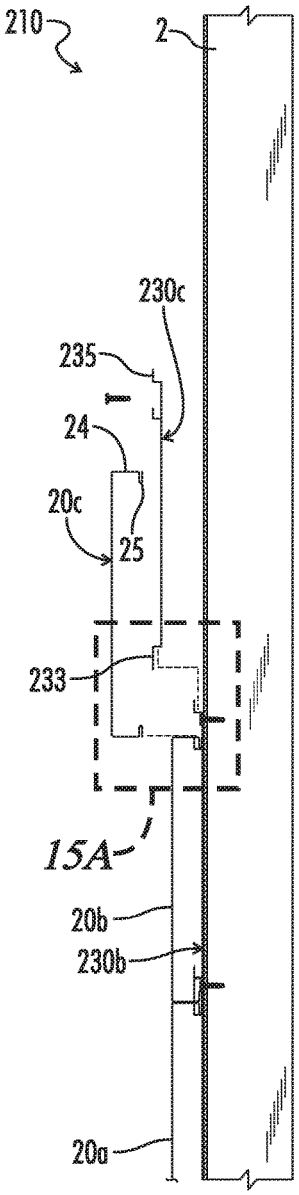
FIGS. 15-16 are sequential, horizontal cross-sectional, partially exploded views illustrating the installation of novel siding 210 on purlins 2 of a wall frame 1.
Figure 15A:
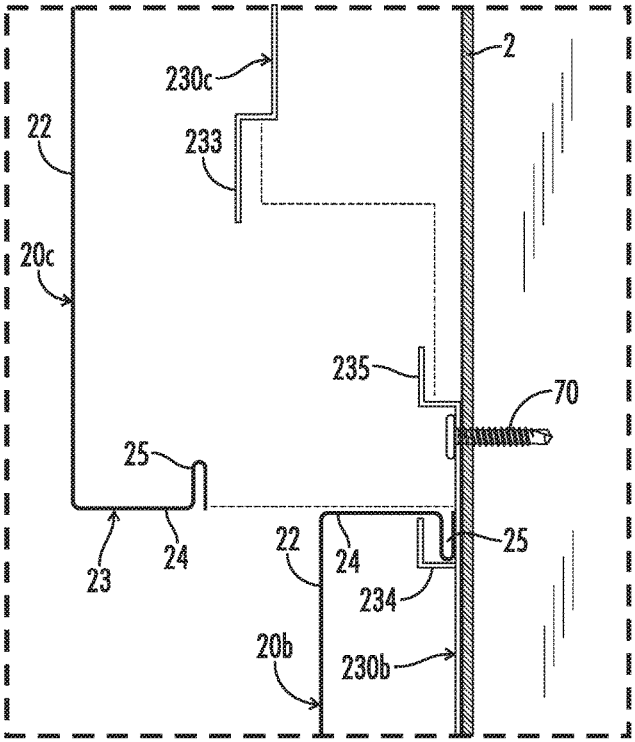
Figure 16:
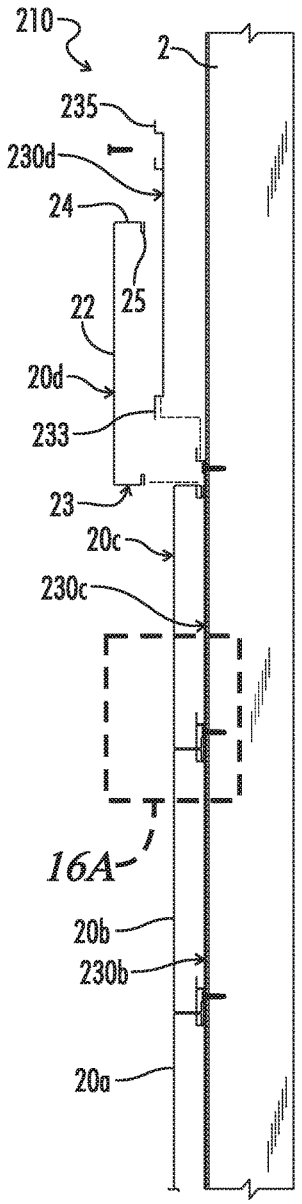
Figure 16A:
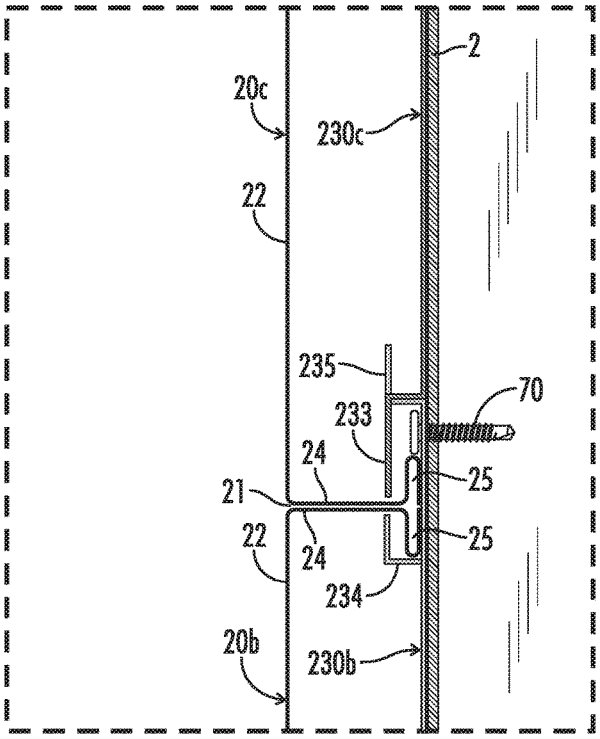

As best seen in FIG. 12, and in contrast to shorter, "individual" clips 30, clips 130 are "continuous" clips, that is, they are quite elongated. For example, in siding 110 clips 130 extend essentially continuously along side laps 23 of panels 20. Clips 130 comprise a base 132 and a pair of flexible arms 134, as seen best in the enlarged cross-sectional view of FIG. 13A. Arms 134 have a first portion or riser 135 that extends upward from and generally perpendicular to base 132. A second portion or flap 136 extends downward and inward from riser 135, extending angularly back toward base 132.

Clips 130 will be installed across girts 3 in frame 1. Panels 20 then may be installed, as shown in FIG. 13, by snapping feet 25 of side laps 23 on adjacent panels 20 into clips 130. Flaps 136 and risers 135 will deflect and allow feet 25 to pass downward into clip 130. Thereafter, flaps 136 and risers 135 will spring back, and engagement between flaps 136 and feet 25 will prevent panels 20 from disengaging.

Because arms 134 are intended to flex, primarily at the bends forming riser 135 and flap 136, clips 130 will be fabricated from lighter gauge metal sheets, such as the metal sheets used to fabricate panels 20. Thus, it generally will be necessary or simply be expedient for clips 136 to extend continuously along panels 20. If resistance to wind lift is not a significant issue, however, clips 136 may not necessarily extend along the entire length of the panels. They may be made shorter, although generally they will still be viewed as "continuous" in the sense that they either extend a substantial distance along a support member or span a plurality of crossing support members.

Like clips 30, clips 130 will securely engage panels 20, but will allow them to float along an array of clips 130 to minimize thermally induced canning. Clips 130 also will allow disengagement of panels 20 without damage if repairs are required. Arms 134 may be flexed or bent away from feet 25 on side laps 23 without damaging panels 20. While disassembly may damage clips 130 to the extent that they may not be reinstalled, it will be appreciated that it will not be necessary to uninstall undamaged panels 20 to access and install a new panel 20. Thus, siding 110 perhaps may be repaired more easily and economically that siding 10.

It will be appreciated that siding 110, like siding 10, also may incorporate straps, such as straps 90. It will be necessary to provide breaks in clips 130 to accommodate installation of straps 90, but if desired, they may be used to help reduce canning in panels 20 of siding 110.

A third preferred embodiment 210 of the novel siding systems is shown in FIGS. 14-17. As may be seen therein, siding 210 in many respects is identical to siding 10. Like siding 10, siding 210 is a horizontal installation on studs 2, and it comprises a plurality of panels 20 installed on linear arrays of clips. Instead of clips 30, however, siding 210 uses clips 230. Clips 230 provide a tongue-in-groove connection between side laps 23 of panels 20.

Figure 17:
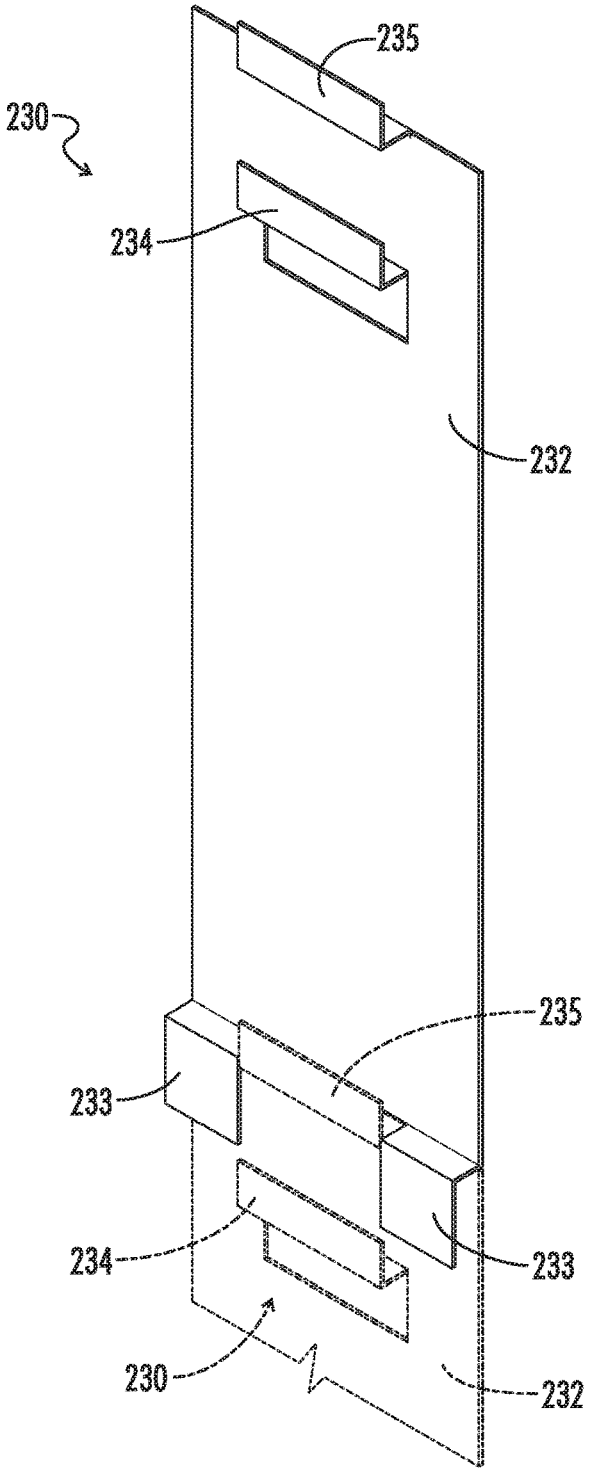
FIG. 17 is an isometric view of a third preferred embodiment 230 of clips used in a third preferred embodiment 210 of the novel metal panel sidings.
Figure 18:
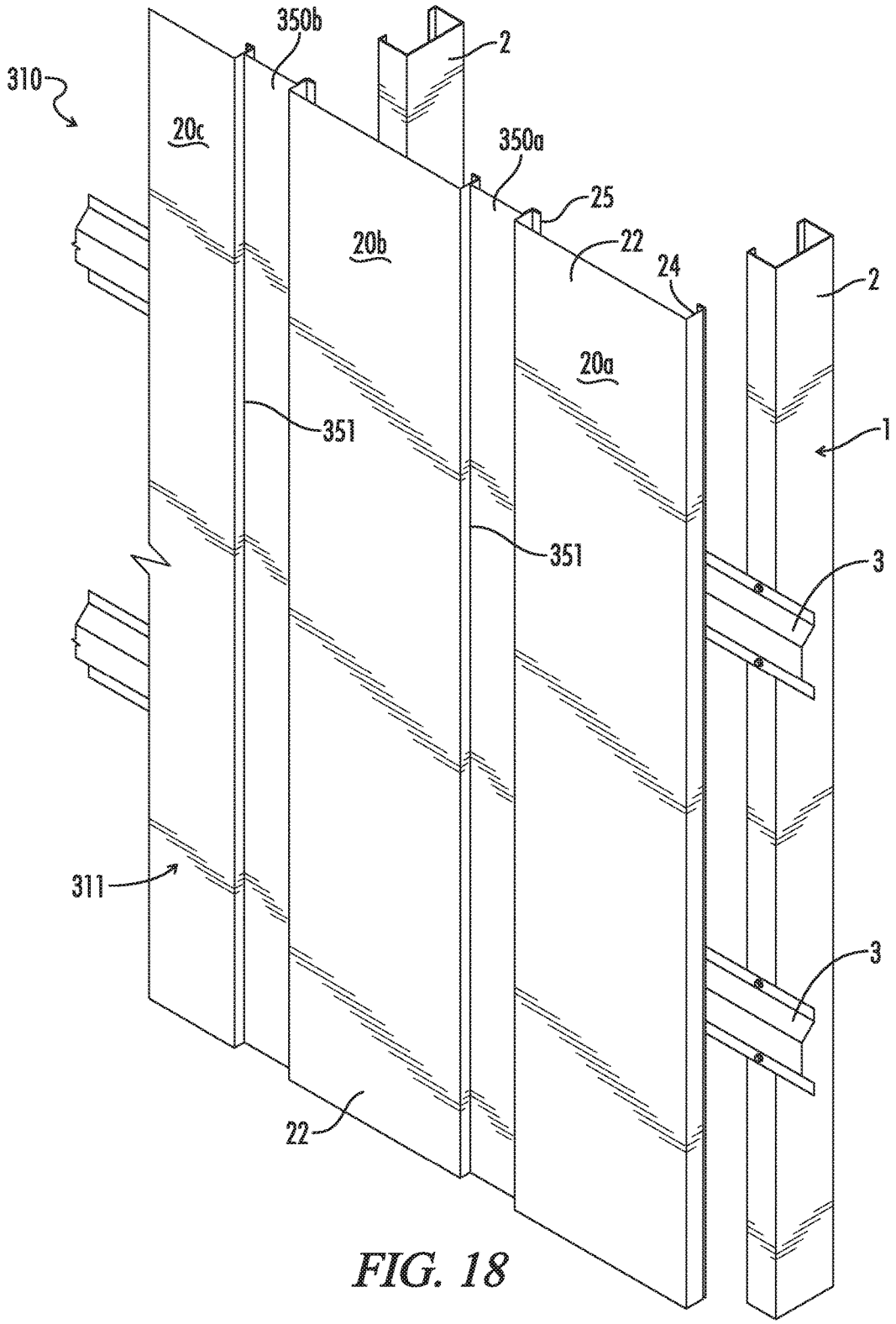
FIG. 18 is an isometric view illustrating a fourth preferred embodiment 310 of the novel sidings which incorporates a reveal panel 350.

As best seen in FIG. 17, clips 230 comprise a base 232, a first catch 233, a second catch 234, and a fence 235. Catch 233 is situated at one end of base 232. Fence 235 is situated at the other end of base 232. Catch 234 is situated near the other end between fence 235 and catch 232. Catches 233 and 234 may be provided, for example, by riser portions having one or more tab portions extending therefrom. Fence 235 may be formed in the same fashion. Holes 237 preferably are provided near the upper end of base 32 to accommodate screws or other fasteners. As discussed further below, the upper end of one clip 230 will cooperate with the lower end of another clip 230 join side laps 23 of adjacent panels 20.

Siding 210 will be installed in order, in a manner not entirely dissimilar to installation of siding 10. As appreciated from FIGS. 14-16, a first, base panel 20*a* will be installed along the base of frame 1 (details not shown) and a second panel 20*b* installed above it on clips 230*b*. Clips 230*b* are installed on studs 2 in horizontal linear arrays, for example, by a screw 70 or other fastener extending through holes 237 on the upper end of clips 230*b*. A third panel 20*c* then may be installed by inserting foot 25 on its lower side lap 23 between side lap 25 on panel 20*b* and fence 235 on clips 230*b*.

Lower catch 233 on another array of clips 230*c* then may be slid over feet 25 on lower side lap 23 of panel 20*c*. Fence 235 on clips 230*b* will extend over, and between the tabs of lower catch 233 of clips 230*c*, thus securing the lower end of clips 230*c*. Clips 230*c* will be mounted on studs 2, for example, by driving fasteners 70 through holes 237 at their upper end. Feet 24 on the upper side lap 23 of panel 20*c* then may be inserted into upper catch 234 of clips 230*c*. A fourth panel 20*d* may be installed in a similar fashion. If desired, straps, such as straps 90, may be provided in siding 210. They may be installed in substantially the same manner as described in reference to siding 10.

Like clips 30, clips 230 will securely engage panels 20, but will allow them to float along an array of clips 230 to minimize thermally induced canning. Clips 230 also will allow disengagement of panels 20 without damage if repairs are required. Clips 230 must be uninstalled, and it will be necessary to remove down-installation panels 20 to access a damaged panel 20. Panels 20, however, may be disengaged from clips 230 without damage and may be reinstalled once a damaged panel 20 has been replaced.

It also will be noted that clips 230 are self-aligning. That is, because clip 230 engages both side laps 23 of a single panel 20, it may be sized accordingly. Once the initial array of clips 230*b* have been installed, there will be no need to measure, align or otherwise determine the placement of clips 230*c* or other clip arrays installed above clips 230*b*.

A fourth preferred embodiment 310 of the novel siding systems is shown in FIGS. 18-24. Siding 310 is in many respects identical to siding 10. Many architects and building owners, however, may opt for an overall flush finish, but may want to vary the elevation of the wall panels in defined area to accent or enhance architectural features of a building. Sidings 10 can accommodate so-called "reveal" panels. The height of legs 24 and the width of show side 22 of panels 20 may be varied to provide reveals of varying elevations and widths. Novel siding 310 also may be used to provide covers with reveal panels as may be seen in FIG. 18.

Figure 19:
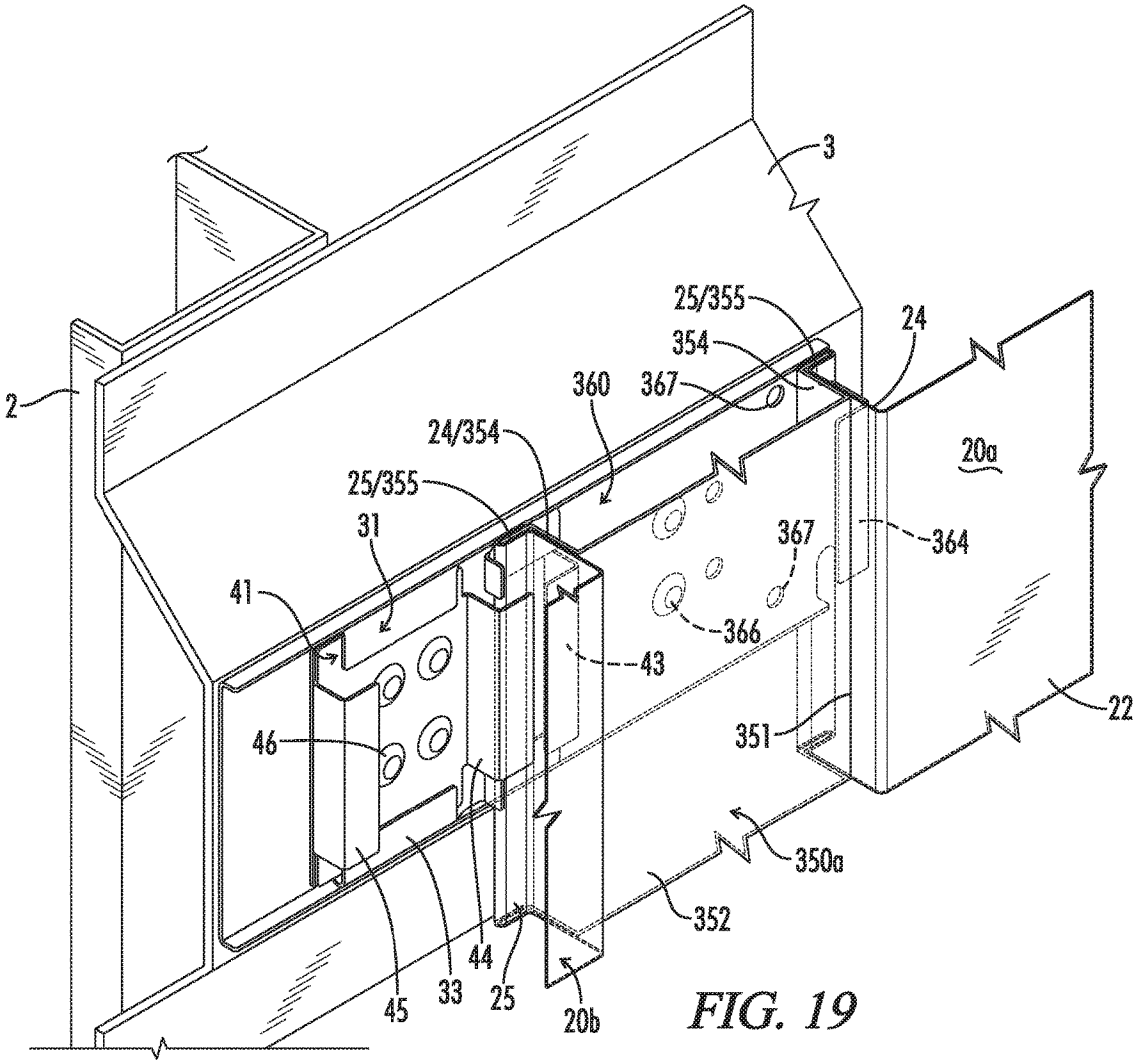
FIG. 19 is an isometric, partial tear-away view of novel siding 310 showing certain installation details.
Figure 20:
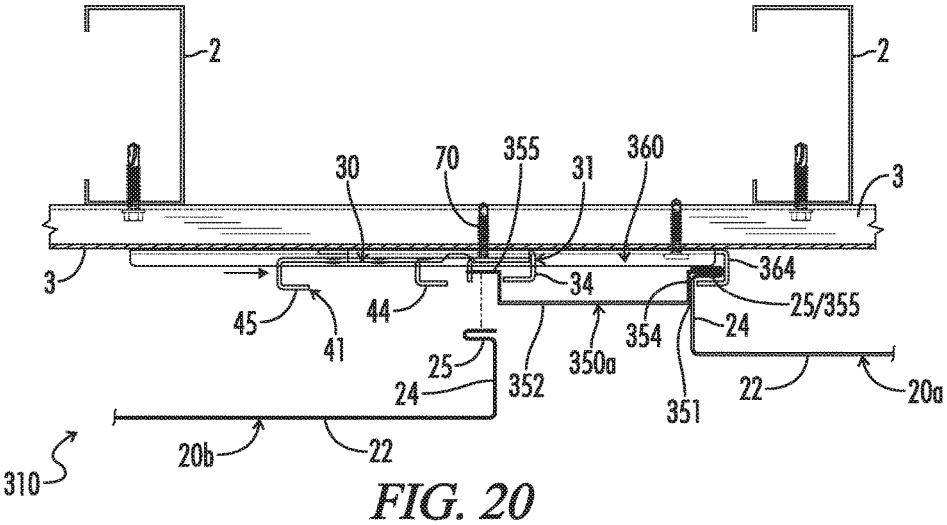
FIG. 20-21 are sequential, cross-sectional, partially exploded views illustrating the installation of novel siding 310.
Figure 21:
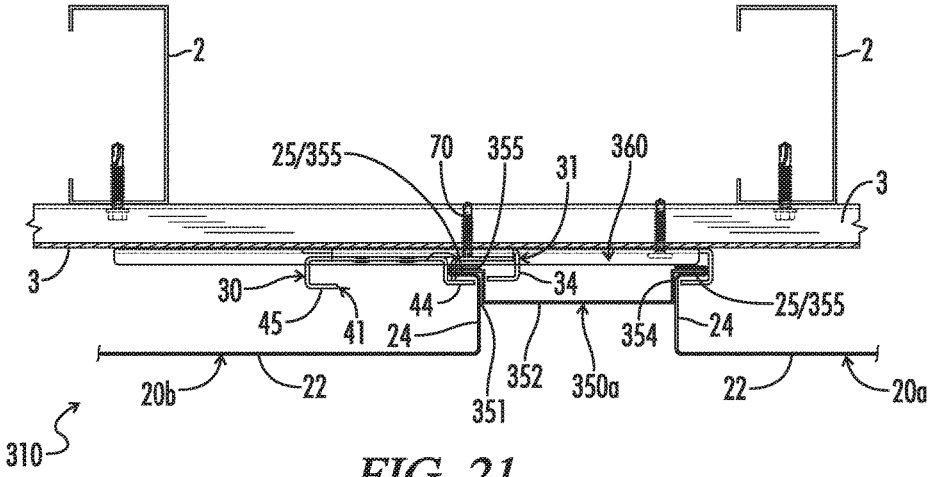

Siding 310, as shown in FIGS. 19-21, generally comprises a plurality of panels 20 installed on linear arrays of clips 30 which in this context will be referred to as standard or flush panels 20 and standard clips 30. Siding 310 also comprises a reveal panel 350 and a first preferred embodiment 360 of the novel reveal panel clips. Siding 310 is a vertical installation, that is, both flush panels 20 and reveal panels 350 run vertically across the face of the wall. Frame 1 includes girts 3 to which clips 30 and 360 are mounted.

Figure 22A:
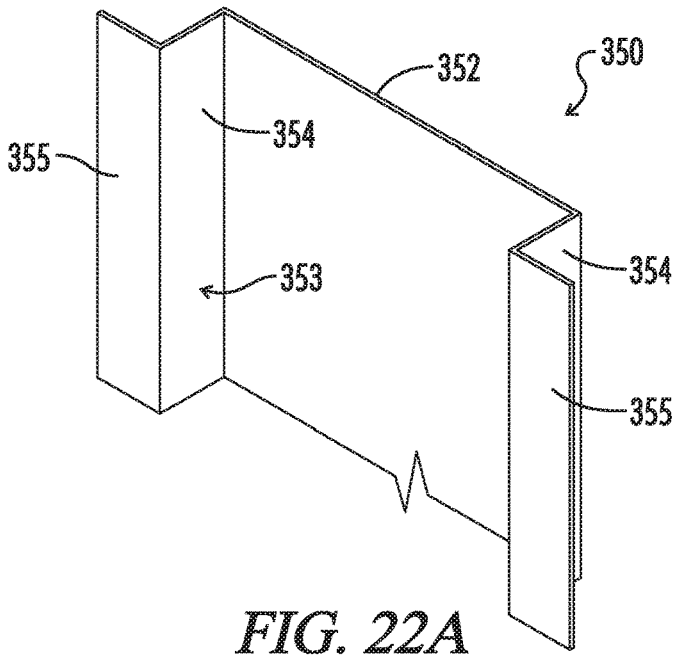
FIGS. 22A and 22B are front and back isometric views of reveal panel 350 used in novel siding 310.
Figure 22B:
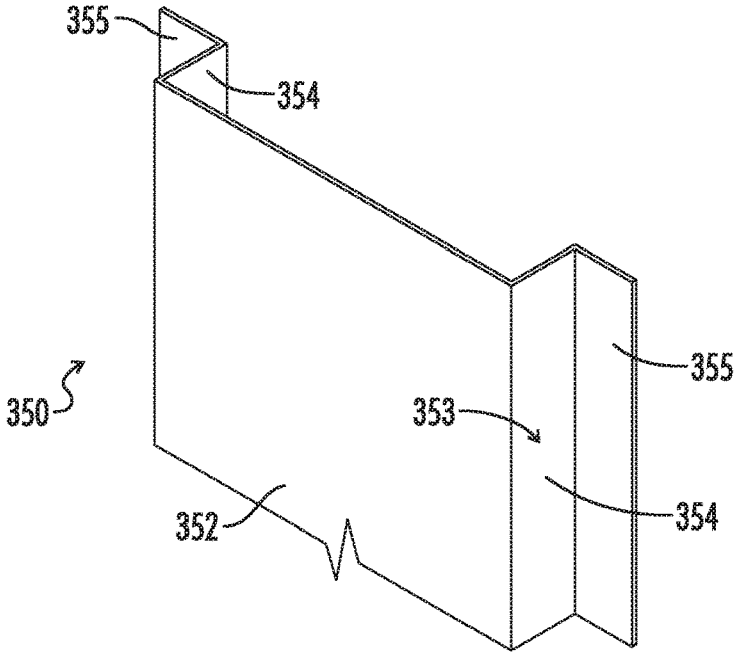

As best seen in FIG. 22, reveal panels 350 are similar in many respects to panels 20. Panels 350 have a show side 352 and side laps 353. Side laps 353 include an inwardly extending leg 354 from which extends a foot 355 which may be joined to form vertical seams 351. Preferably, as shown, leg 355 extends approximately perpendicular to show side 352, and foot 355 extends generally parallel to and away from show side 352. Like panels 20, panels 350 are symmetrical, that is, their side laps 353 are mirror images.

Reveal panels of the novel sidings, however, are elevated away from the wall to a greater or lesser extent than the flush panels. For example, as may be seen best in FIGS. 18 and 19-21, side laps 353 of reveal panels 350 support show side 352 away from girt 3 at an elevation less than that of show side 22 of flush panels 20. Show side 352 of reveal panels 350, therefore, is recessed relative to show side 22 of flush panels 20.

Figure 23:
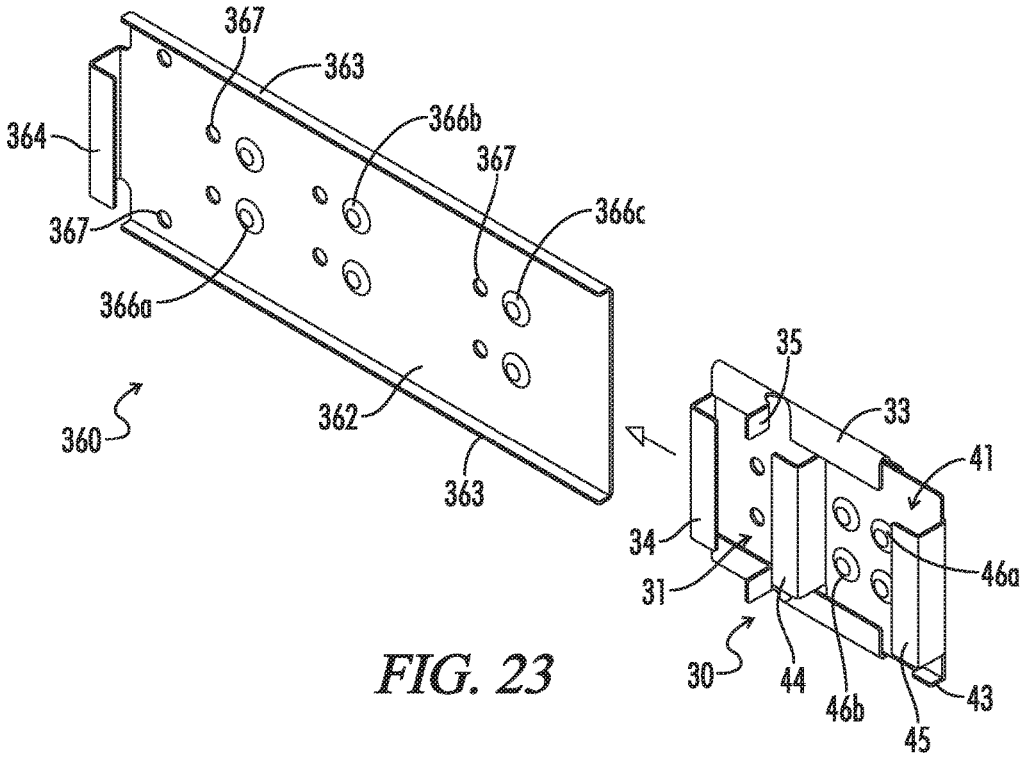
FIG. 23 is an isometric, exploded view of a first preferred embodiment 360 of reveal clips and clip 30 used in novel siding 310.
Figure 24:
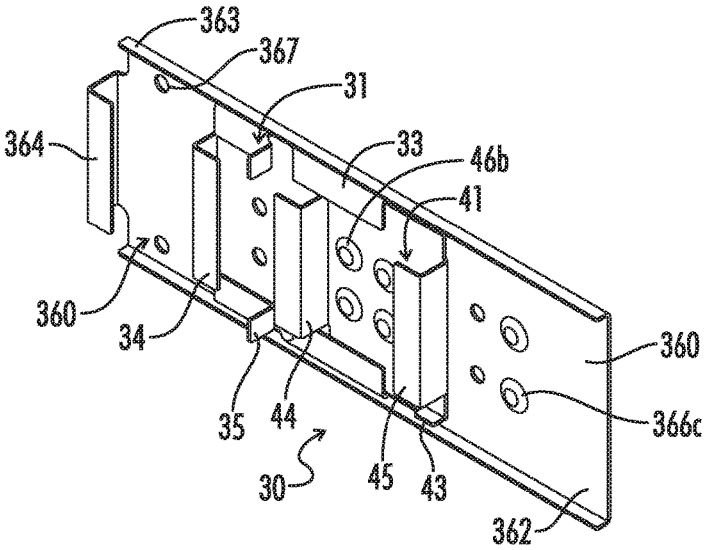
FIG. 24 is an isometric view of an assembly of reveal clip 360 and clip 30 used in novel siding 310.

As shown in FIGS. 23-24 and described further below, reveal clips 360 are adapted to carry a standard clip 30 to allow installation of reveal panels 350. Accordingly, reveal clips 360 generally comprise a bottom plate or base 362 which has been shaped to provide a pair of guides 363 along its sides and a catch 364 at its forward end. Guides 363 may be provided, for example, by low, rims extending upward from base 362 and running the length of reveal clip 360. Guides 363 are spaced apart a distance slightly greater than the width of track 31 of standard clips 30 and, therefore, facilitate alignment of standard clips 30 on reveal clips 360.

Catch 364 is like catch 34 on track 31 of standard clip 30. It may be provided, for example, by an upward extension from base 362 which is doubled back to form a rearward-facing hook. Catch 364 extends across the substantial portion of the forward end of reveal clip 360.

Preferably, base 362 of reveal clips 360 also is provided with embossments. For example, reveal clips 360 have three sets of paired nubs 366 provided in base 362. Nubs 366 project upward from base 362 and are substantially identical to nubs 36 of track 31 of standard clips 30. Thus, as described in detail below, a standard clip 30 may be registered in defined locations along the length of reveal clips 360 by registering nubs 36 on track 31 with one or the other set of nubs 366 on reveal clip 360.

The installation of siding 310 is best appreciated from the sequential, cross-sectional, partially exploded views of FIGS. 20-21. Reveal clips 360 are mounted in a vertical array running from girt 3 to girt 3 along what will become a seam line 351 between flush panels 20 and reveal panels 350. Reveal clips 360 may be mounted on girts 3, for example, by screws 70 or other fasteners extending through base 363 of reveal clips 360. Preferably, holes 367 or other openings are provided in base 362 of reveal clips 360 through which screws 70 may be passed.

A first panel 20*a* then may be installed by sliding foot 25 on its side lap 23 under catch 364 of reveal clips 360. Foot 355 on one side lap 253 of reveal panel 350 then will be inserted into the fold of foot 25 on first panel 20*a*, as shown in FIG. 20.

After the first side lap 353 of reveal panel 350 is secured, an array of standard clips 30 may be mounted on reveal clips 360. Paired nubs 366 on reveal clip 360 are spaced along base 362 such that reveal panels 350 of various standard widths may be accommodated by selectively registering clip 30 along reveal clip 360. For example, as appreciated by comparing FIGS. 23 and 24, nubs 36*b* on track 31 of standard clips 30 may be registered with nubs 366*b* on reveal clips 360 to accommodate a medium width reveal panel 350. Holes 37 in track 31 preferably, as shown, align with one set of holes 367 in reveal clip 360. Thus, standard clips 30 may be mounted to girts 3, for example, by driving screws 70 or other fasteners through holes 37 in track 31 and holes 367 in reveal clip 360.

The fold of foot 25 of side lap 23 of a second flush panel 20*b* then may be cupped around foot 365 of the other side lap 263 of reveal panel 350. So coupled, foot 25 of flush panel 30 and foot 255 of reveal panel 350 are inserted between catch 34 and fence 35 on track 31. Sled 41 on standard clip 30 then may be slid from its unset position to its set position such that catch 44 extends over foot 25 on the lower side lap 23 of second flush panel 20*b*. Straps, such as straps 90, also may be installed in siding 310 as in other novel siding systems. They may be used to help reduce oil canning in panels 20 of siding 310.

Like standard clips 30, reveal clips 360 will securely engage flush panels 20 and reveal panels 350, but will allow them to float along an array of reveal clips 360 to minimize thermally induced oil canning. Reveal clips 360 also will allow disengagement of reveal panels 350 without damage if repairs are required. It will be necessary to remove down-installation panels 20 and reveal panels 350 to access a damaged reveal panel 350. Down-installation panels 20 and 350, however, may be disengaged from standard clips 30 and reveal clips 360 without damage and may be reinstalled once a damaged reveal panel 350 has been replaced.

Figure 25:
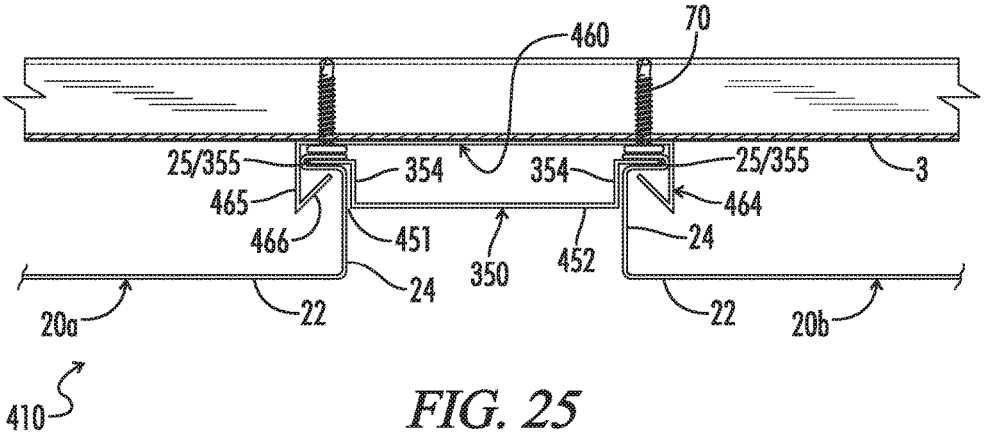
FIG. 25 is a cross-sectional view of a field portion of a fifth preferred embodiment 410 of the novel sidings.
Figure 26:
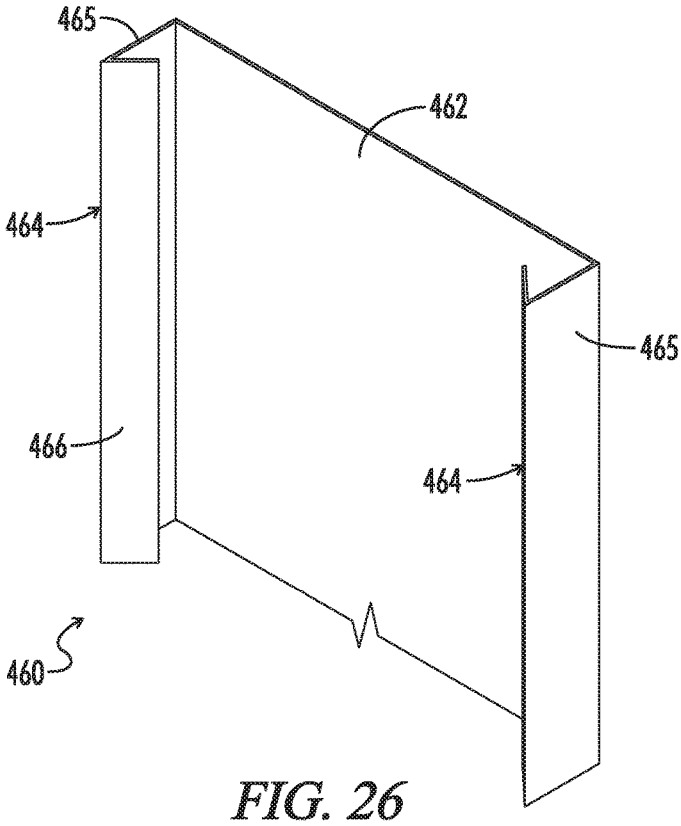
FIG. 26 is an isometric view of a second preferred embodiment 460 of reveal clips used in novel sidings 410.

A fifth preferred embodiment 410 of the novel siding systems is shown in FIGS. 25-26. Siding 410 is similar in ways to siding 110. Siding 410 is a vertical installation employing girts 3 in frame 1. Like siding 110, siding 410 can incorporate both flush panels 20 and reveal panels 350 of varying heights and widths into the cover, and it uses continuous-style clips. Siding 410, however, uses a second preferred embodiment 430 of the novel reveal panel clips instead of clips 130.

In general, siding 410 comprises flush panels 20, reveal panels 350, and reveal clips 460. Reveal clips 460, like clips 130, are quite elongated and extend essentially continuously along side laps 23 of flush panels 20 and side laps 353 of reveal panels 350. As with clips 130, however, clips 460 may have varying lengths depending on the requirements of the installation or for the sake of expediency.

Reveal clips 460 also have a snap-in design similar to clips 130. As best seen in FIG. 23, reveal clips 460 comprise a base 462 and a pair of flexible arms 464. Flexible arms 464, however, are spaced to accommodate and secure reveal panels 350 of varying widths as described further below. Arms 464 have a first portion or riser 465 that extends upward from and generally perpendicular to base 462. A second portion or flap 466 extends downward and inward from riser 465, extending angularly back toward base 462. Like snap-in clips 130 of siding 110, reveal clips 460 preferably are fabricated from lighter gauge steel which will allow arms 464 to flex at the bends forming riser 465 and flap 466.

Clips 460 will be mounted on girts 3, for example, by driving screws 70 or other fasteners through their base 462. Foot 25 of side lap 23 on a first flush panel 20*a* will be snapped into one flexible arm 464 on reveal clip 460. Foot 355 on one side lap 353 of reveal panel 350 then will be inserted into the fold of foot 25 on side lap 23 of first panel 20*a* as shown in FIG. 22. Foot 25 of side lap 23 of a second panel 20*b* then may be cupped around foot 365 of the other side lap 263 of reveal panel 350. So coupled, foot 25 and foot 365 are snapped into the other flexible arm 464 on reveal clip 460.

Clips 460 will securely engage panels 20 and reveal panels 350, but will allow them to float along an array of clips 460 to minimize thermally induced oil canning. Moreover, if a reveal panel 350 is damaged, it may be replaced without uninstalling any undamaged panels 20 and reveal panels 350. Once the damaged reveal panel 350 has been removed, side laps 23 of adjacent flush panels 20 may be disengaged from reveal clips 460. Feet 355 of side laps 353 on a replacement reveal panel 350 may be tucked into the fold of feet 25 on side laps 23 of adjacent flush panels 20 and then snapped into flexible arms 464 on reveal clip 460.

It will be appreciated that siding 410 also, like siding 110, also may incorporate straps, such as straps 90. It will be necessary to provide breaks in clips 430 to accommodate installation of straps 90, but if desired, they may be used to help reduce canning in panels 20 of siding 410.

Figure 27:
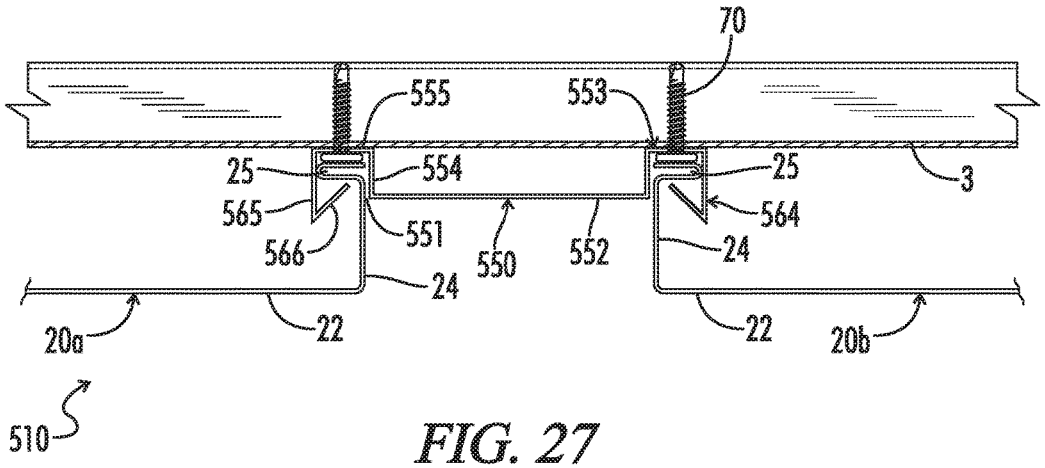
FIG. 27 is a cross-sectional view of a field portion of a sixth preferred embodiment 510 of the novel sidings.
Figure 28:
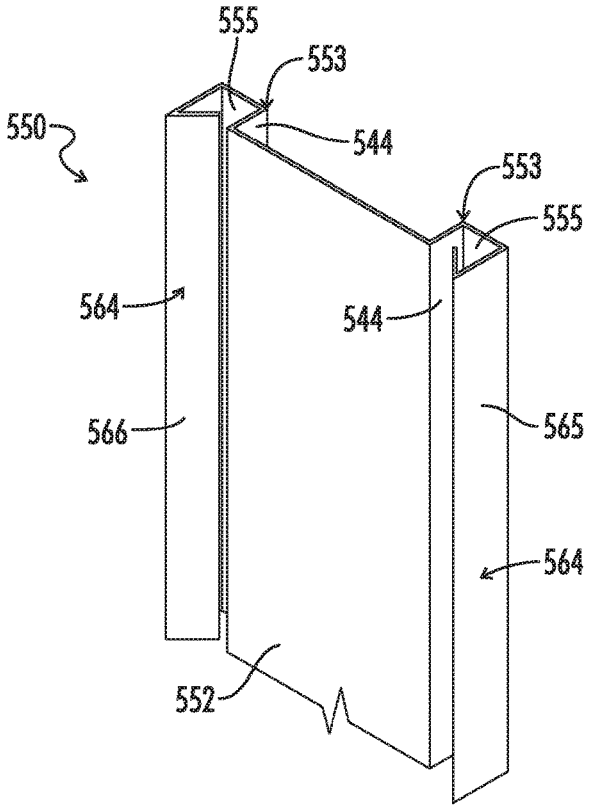
FIG. 28 is an isometric view of a preferred embodiment 550 of a reveal panel which is used in novel sidings 510.

A sixth preferred embodiment 510 of the novel siding systems is shown in FIGS. 27-28. Siding 510 in many respects is similar to siding 410. Siding 510 also is a vertical installation employing girts 3 in frame 1. Siding 510, however, uses a preferred embodiment 550 of novel self-clipping reveal panels. Reveal panels 550 are installed without clips, but incorporate clip-like features similar to reveal panel clips 460 in siding 410. Reveal panels 560 provide a snap-in connection between side laps 23 of flush panels 20 and side laps 553 of reveal panels 550.

As best seen in FIG. 28, reveal panels 550 are similar in certain respects to reveal panels 350. Panels 550 have a show side 552 and side laps 553. Side laps 553 include an inwardly extending leg 554 from which extends a foot 555. Feet 555, however, provide a base for a pair of flexible arms 564 similar to flexible arms 464 on reveal clips 460 of siding 410. Flexible arms 564 have a first portion or riser 565 that extends upward from and generally perpendicular to feet 555. A second portion or flap 566 extends downward and inward from riser 565, extending angularly back toward feet 555. Like snap-in clips 460 of siding 410, reveal panels 550 preferably are fabricated from lighter gauge steel which will allow arms 564 to flex at the bends forming riser 565 and flap 566.

As shown in FIG. 27, unlike reveal panels 350 used in sidings 310 and 410, panels 550 in siding 510 will be installed directly on girts 3 by fasteners 70 extending through feet 555 of panels 550. Foot 25 on side lap 20*a* of a first panel 20*a* then is snapped into one flexible arm 564 on reveal panel 550. Foot 25 on side lap 23 of a second panel 20*b* then may be snapped into the other flexible arm 564 on reveal panel 550.

Panels 550 will securely engage panels 20 and reveal panels 550, but will allow them to float along an array of panels 550 to minimize thermally induced canning. Moreover, if a reveal panel 550 is damaged, it may be replaced without uninstalling any undamaged panels 20 and reveal panels 550 in a manner similar to replacing reveal panels 350 in siding 410.

It will be appreciated that the novel straps may be used in siding systems other than those exemplified by siding 10 and the other siding systems disclosed above. For example, they may be incorporated into a seventh preferred embodiment 610 of the novel siding systems shown in FIGS. 29-33. As shown therein, siding 610 may be installed on a conventional lumber frame 601. Frame 601 includes an array of vertically extending support members, such as dimensional lumber studs 602. A sheathing 603, such as a continuous plywood or oriented strand board (OSB) is mounted to studs 602. The siding systems, however, may be installed on other conventional frames. Metal studs, for example, may be used, or the sheathing may be wooden planks or space boards. An underlayment, such as asphalt-saturated felt (tar paper), may be installed to protect the sheathing. Other barrier webs may be installed both outside and inside the sheathing, such as reflective barriers or moisture barriers. In any event, frame 601 will provide a support on which siding 610 will be installed.

Figure 29:
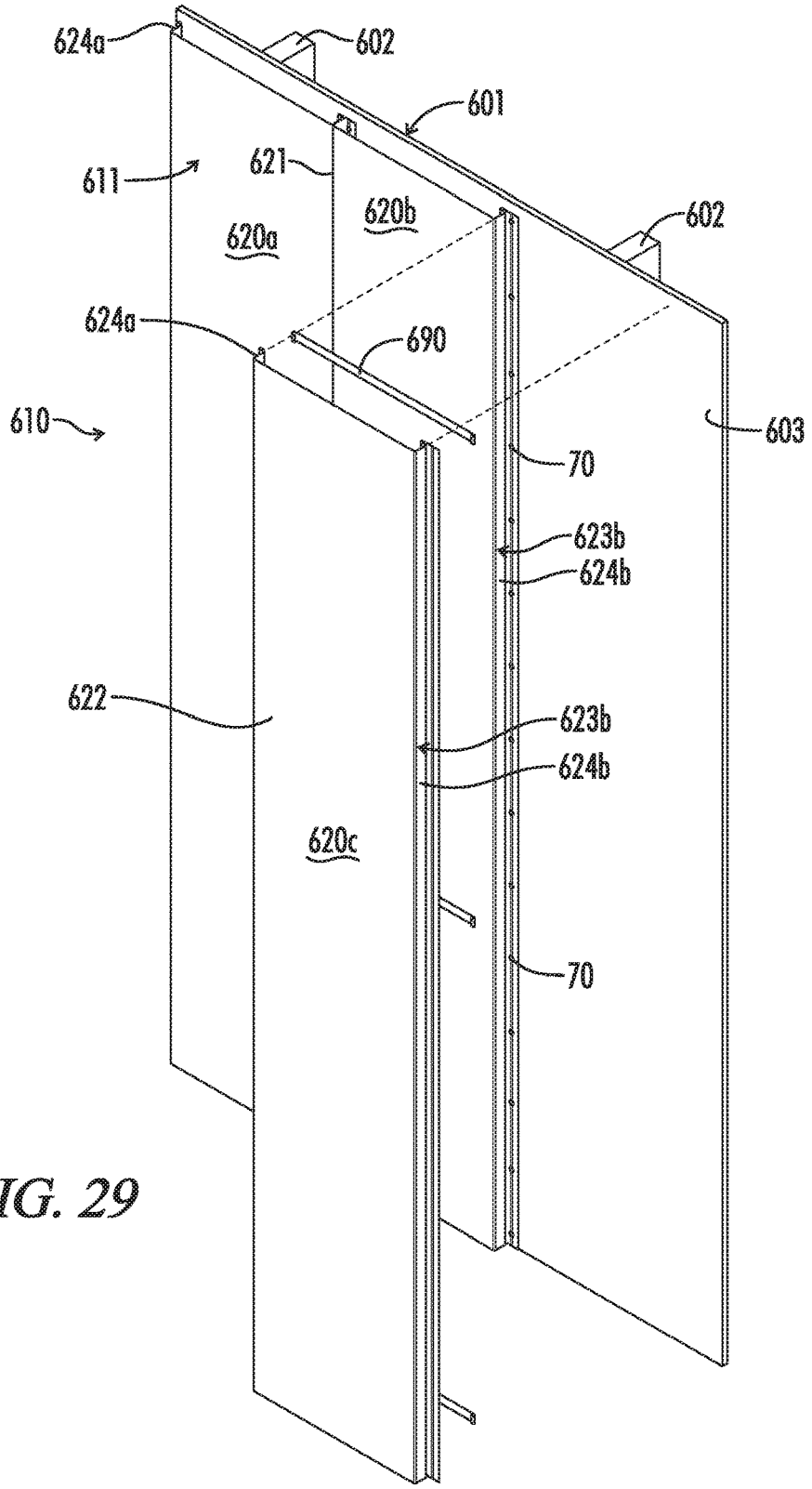
FIG. 29 is an isometric, partially exploded view of a field portion of a seventh preferred embodiment 610 of the novel metal panel sidings.
Figure 30:
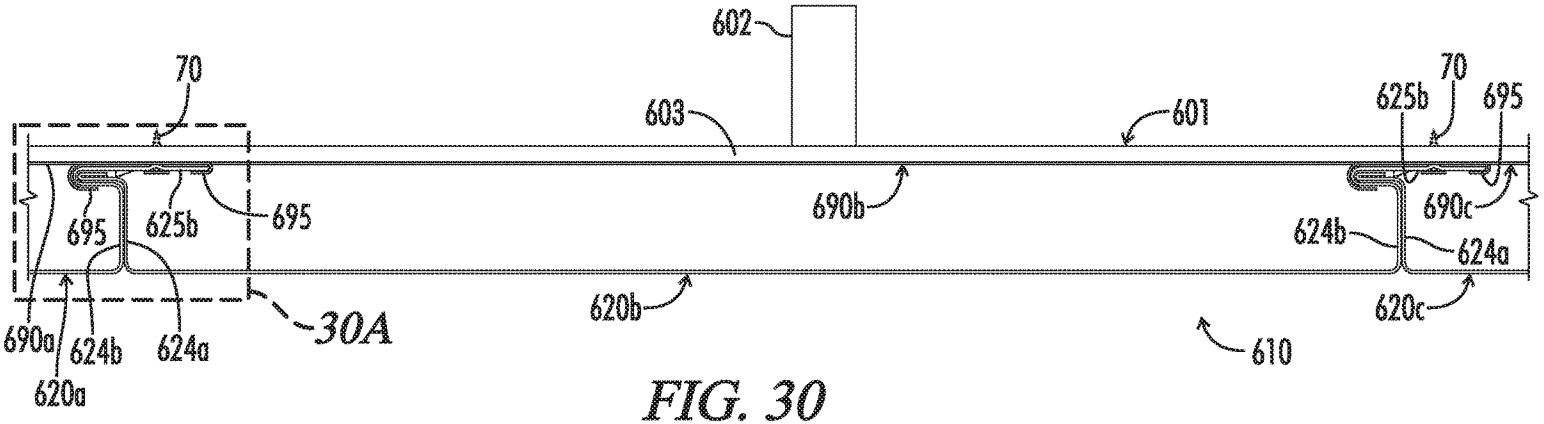
FIG. 30 is a cross-sectional view of a field portion of novel siding 610, an enlarged portion thereof being shown in FIG. 30A.
Figure 30A:
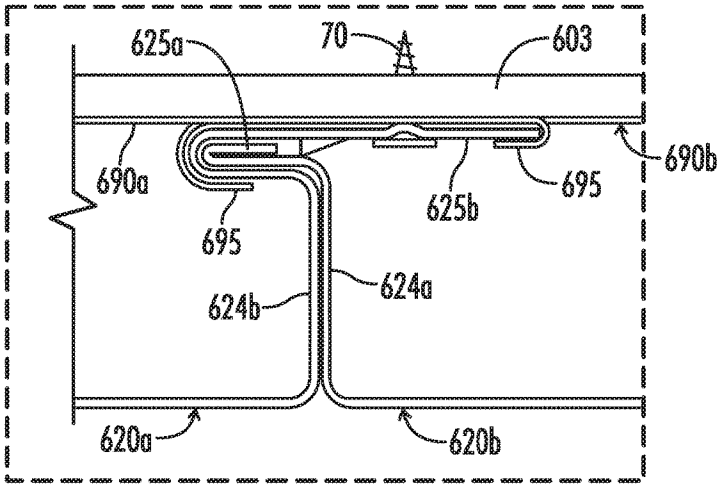
Figure 31:
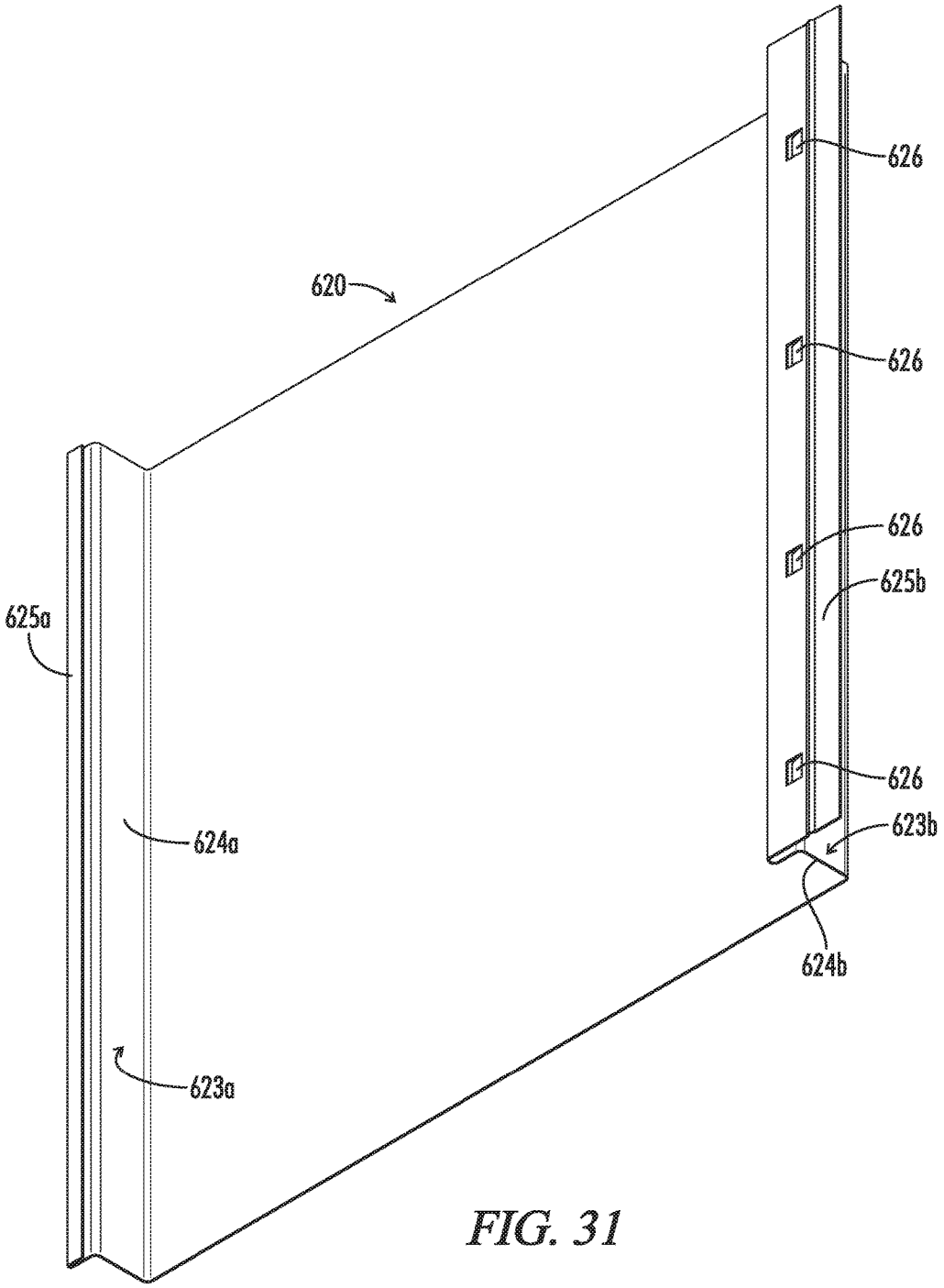
FIG. 31 is an isometric view, taken generally from the back, of panel 620 used in siding 610.

Novel siding 610 generally comprises a plurality of metal wall panels 620 and a plurality of panel straps 690. As best appreciated from FIG. 29, siding 610 is a "vertical" installation. The portion of panels 620 which extends between seams 621 provides an external face or "show" side 622. Panels 620 will be installed across frame 601 in a prescribed order. For example, as illustrated in FIG. 29, panels 620 will be installed from left to right. A first panel 620*a* will be installed proximate a corner of frame 601, typically with one or more corner trim pieces (not shown). A second panel 620*b* will be installed to the right of first panel 620*a*, and so on until the next corner of frame 601 is reached and frame 601 is completely covered.

Panels 620 have side laps 623 which may be joined to form horizontally extending, vertical seams 621. Side laps 623 are formed by bending the lateral edges of panels 620 into a desired configuration. For example, as best appreciated from FIG. 31, side laps 623 of panels 620 are asymmetrical. That is, side laps 623 include a male side lap 623*a* and a female side lap 623*b*. Both side laps 623 have inwardly extending legs 624 and feet 625. Foot 625*a* on male side lap 623*a* has a relatively short, folded portion which extends approximately perpendicularly and outward from leg 624*a*. Foot 625*b* on female side lap 623*b* has a relatively short, folded portion which extends approximately perpendicularly and inward from leg 624*b* and an extended "fastener" portion extending outward from leg 624*b*. Panels 620 will be installed by driving fasteners 70 through fastener portion of female foot 625*b*. Tabs 626 extend inward and toward the folded portion of female foot 625*b* and, as described below, assist in forming a seam 621 between adjacent panels 620.

Figure 32:
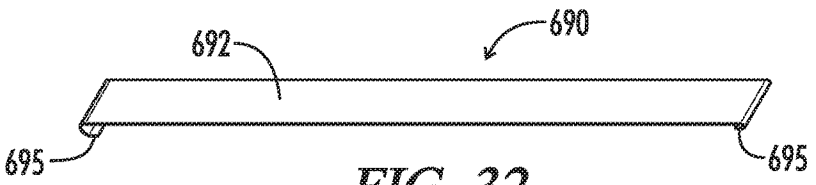
FIG. 32 is an isometric view of a second preferred embodiment 190 of the novel panel straps used in siding 610.
Figure 33:
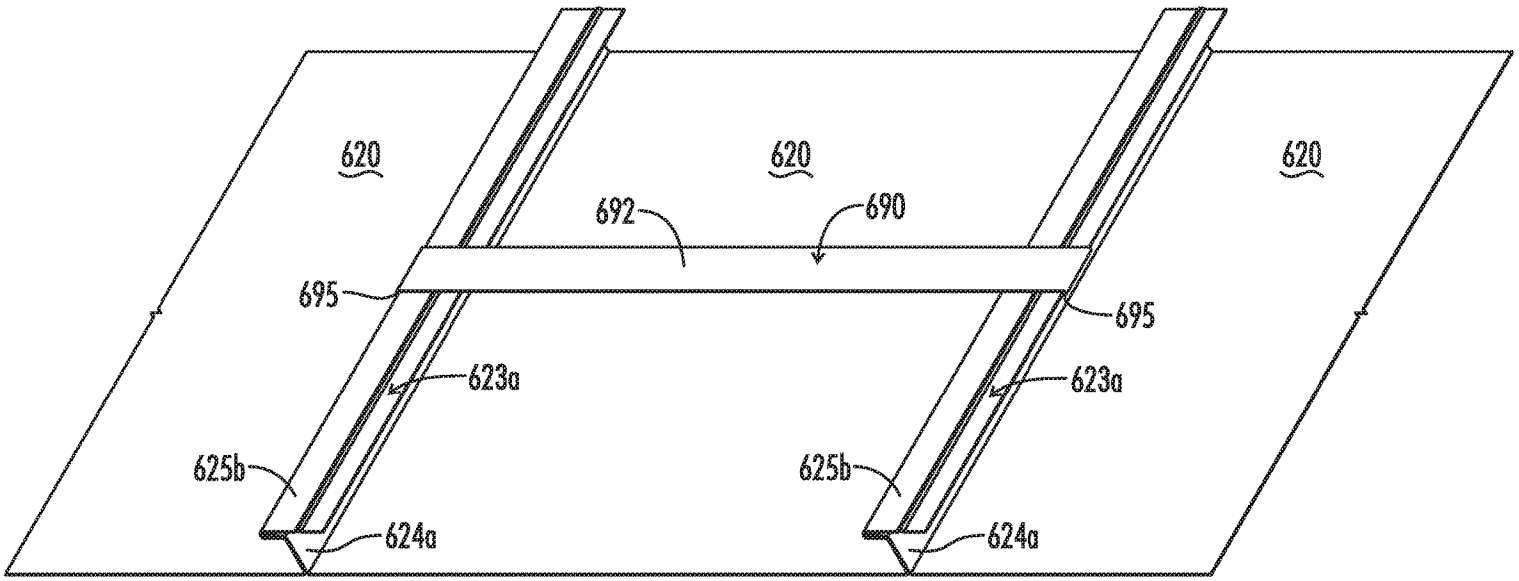
FIG. 33 is an isometric view, taken generally from the back, showing an assembly of panels 620 having strap 190 assembled thereto.

As best appreciated from FIGS. 32 and 33, straps 190 are substantially similar to straps 90 used in siding 10. Straps 692 have a relatively thin, narrow body 692 having a transverse hook 695 at each end. In contrast to straps 90, however, straps 690 are installed across adjoining panels 620. That is, one hook 695 on one end of strap 690 is engaged with the female foot 625*b* on panel 620*a*. The other hook 695 is engaged with the female foot 625*b* on adjacent panel 620*b*. As in siding 10, straps 690 in siding 610 will induce a slight, outward bow running transversely along the length of panel 620*b*. It will be noted that one hook 695 of straps 690 is somewhat enlarged relative to the other hook 695 given that hooks 695 engage different edges of female feet 625*b*.

In contrast to siding 10, for example, siding 610 is not installed with clips. It is installed on frame 601 with concealed fasteners 70. More particularly, as best appreciated from FIG. 29, siding 610 may be installed by installing a first panel 620*a* (far-left as shown in figure) along a corner of frame 601. The male side lap 623*a* of the first panel 620*a* is secured at the corner of frame 601 by conventional fasteners and corner trim (not shown). Such components, and other conventional components that may be used in the corner area of frame 601 and siding 610 have been omitted from the drawings for the sake of clarity.

The larger hook 695 on straps 690*b* then may be hooked over the folded portion of female foot 625*b* on first panel 620*a*. Fasteners 70 then will be driven through fastener portion of female foot 625*b* and into sheathing 603 to securely mount panel 620*a* to frame 601. As in siding 10, greater or fewer straps 690 may be used in siding 610. Greater or fewer fasteners 70 also may be used depending upon the conditions to which siding 610 will be exposed, and primarily on the degree to which wind uplift is a concern.

Once first panel 620*a* has been installed, the next panel 620*b* may be installed. More specifically, male foot 625*a* of second panel 620*b* will be inserted into the folded portion of foot 625*b* of panel 620*a*. Tabs 626 of female foot 625*b* will flex inward to allow insertion of male foot 625*a*, but will flex out again to secure male foot 625*a* within female foot 625*b*. Preferably, a sealant, such as a bead of silicone caulk or elastomeric tape, will be provided between male foot 625*a* and female foot 625*b* of side laps 623 of panels 620 to enhance the weather tightness of seams 621. In any event, male side lap 623*a* on second panel 620*b* will be securely engaged with female side lap 623*b* on first panel 620*a* to form a vertical seam 621 therebetween.

Once that seam 621 has been formed, the smaller hook 695 on straps 690*b* may be hooked over the fastener portion of female foot 625*b* of second panel 620*b*. Installation of strap 690*b* will induce slight, transverse bowing of second panel 620*b*. A second series of straps 690*c* then may be installed by first engaging the larger hook 695 of second series straps 690*c* over the folded portion of female foot 625*b* of second panel 620*b*. Fasteners 70 then will be driven through the fastener portion of female foot 625*b* of second panel 620*b* to complete its installation. The process then may be repeated to complete the installation of second series straps 690*c* and additional panels 620.

It also will be appreciated that the panel straps have been exemplified as being incorporated into panels of a particular configuration. Siding 10, for example, incorporates symmetrical panels 20. Siding 610 incorporates asymmetrical panels 620. Other types of asymmetrical panels may be used, however, and a variety of conventional symmetrical and asymmetrical panels which form vertical seams are known and may be adapted for use in the subject invention. For example, the novel straps may be used with Marquee-Lok, Marquee II, and FW Series asymmetrical metal panels sold by McElroy Metal.

While this invention has been disclosed and discussed primarily in terms of specific embodiments thereof, it is not intended to be limited thereto. Other modifications and embodiments will be apparent to the worker in the art.

What is claimed is:

1. A metal panel siding system installed on a structure, said siding system comprising:

(a) a plurality of panel clips mounted in linear arrays to a wall of said structure;

(b) a cover attached to said panel clips, said cover comprising a plurality of elongated metal panels having lateral side laps and a show side extending between said side laps, wherein said side laps extend inward from said show side;

(c) a plurality of straps, said straps engaging said side laps of said panels and extending therebetween to provide lateral flex in said panels;

(d) wherein said panel clips comprise a first catch engaging one of said side laps of a first one of said panels and a second catch engaging one of said side laps of a second, adjacent one of said panels, said side laps thereby providing vertical seams between said adjacent panels;

(e) wherein said first catch is mounted to said wall and said second catch is coupled to said first catch for movement relative to said first catch; said second catch being moveable during installation of said panels from an unset position where said second catch does not engage said one of said side laps of said second panel to a set position providing said engagement with said one of said side laps of said second panel.

2. The siding system of claim 1, wherein said side laps of said panels comprise a leg portion extending inward from said show side of said panel and a foot portion extending from said leg generally parallel to and under said show side.

3. The siding system of claim 1, wherein said panels are symmetrical.

4. The siding system of claim 2, wherein said straps comprise a hook at each end of said strap, said hooks being adapted to engage said foot portions of said side laps of a said panel and extend therebetween to provide lateral flex in said panel.

5. A method of providing a wall cover for a structure, said method comprising:

(a) installing a plurality of panel clips on a wall of said structure, said panel clips being installed in linear arrays running across said wall and having a mountable catch and a settable catch, said settable catch being moveable relative to said mountable catch; and (b) attaching elongated metal panels to said panel clips to form at least a portion of said wall cover, said panels having an inwardly extending side lap; wherein said panel clips are installed and said panels are attached to said panel clips by:

i) engaging one of said side laps of a first one of said panels with said mountable catches of one or more said panel clips;

ii) installing said mountable catches on said wall;

iii) installing a plurality of straps on said side laps of a second one of said panels to provide lateral flex in said second panel;

iv) placing one of said side laps of said second panel adjacent said side lap of said first panel; and v) moving said settable catches of said panel clips into engagement with said side lap of said second panel.

6. A metal panel siding system installed on a structure, said siding system comprising:

(a) a cover installed on a wall of said structure, said cover comprising a plurality of elongated metal panels having lateral side laps and a show side extending between said side laps;

(b) a plurality of straps, said straps engaging said side laps of said panels and extending therebetween and providing lateral flex in said panels.

7. The metal panel system of claim 6, wherein one of said side laps of a first one of said panels and one of said side laps of a second, adjacent one of said panels are engaged to provide vertical seams between said adjacent panels.

8. The metal panel system of claim 7, wherein said panels are asymmetrical panels and said straps engage one of said side laps of a first one of said panels and one of said side laps of a second one of said panels.

9. The metal panel system of claim 7, wherein said panels are symmetrical panels and said straps engage said side laps of a same said panel.

10. A panel clip for a metal panel siding system, said system comprising a plurality of elongated metal panels adapted for assembly into a cover, said panel clip comprising:

(a) a first catch adapted to engage a side lap of a first said metal panel; and (b) a second catch adapted to engage a side lap of a second, adjacent said metal panel;

(c) said side laps thereby providing vertical seams between said adjacent panels;

(d) wherein said first catch is adapted for mounting to a wall of a structure and said second catch is coupled to said first catch for movement relative to said first catch; said second catch being moveable during installation of said panels from an unset position where said second catch does not engage said side lap of said second panel to a set position where said second catch engages said side lap of said second panel.

11. The panel clip of claim 10, wherein said first catch and said second catch are adapted to engage said panel side laps such that said panel clip does not restrict movement of said panels along a linear array of a plurality of said panel clips.

12. The panel clip of claim 10, wherein said second catch is coupled to said first catch for movement between said unset position and said set position.

13. The panel clip of claim 10, wherein said first catch has guides adapted to receive said second catch such that said second catch can slide from said unset position to said set position.

14. The panel clip of claim 10, wherein said second catch may be releasably locked in said unset position or said set position.

15. The panel clip of claim 14, wherein said first catch and said second catch are provided with mating nubs adapted for releasable engagement to releasably lock said second catch in said unset or said set position.

16. The panel clip of claim 10, wherein said panel clip comprises a vertical fence restricting lateral movement of said side laps of said panels.

17. The panel clip of claim 16, wherein said fence is provided on said second catch.

18. The panel clip of claim 10, wherein said panel clip comprises a stop limiting movement of said second catch past said set position.

19. The panel clip of claim 18, wherein said stop comprises a tab on said second catch adapted to engage a track on said first catch.

* * * * *